US010747154B2

(12) United States Patent
Seki

(10) Patent No.: US 10,747,154 B2
(45) Date of Patent: Aug. 18, 2020

(54) FIXING DEVICE AND IMAGE FORMING APPARATUS

(71) Applicant: Takayuki Seki, Kanagawa (JP)

(72) Inventor: Takayuki Seki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/659,646

(22) Filed: Oct. 22, 2019

(65) Prior Publication Data

US 2020/0209791 A1 Jul. 2, 2020

(30) Foreign Application Priority Data

Dec. 27, 2018 (JP) ..... 2018-245340

(51) Int. Cl.
*G03G 15/20* (2006.01)

(52) U.S. Cl.
CPC ..... *G03G 15/2053* (2013.01)

(58) Field of Classification Search
CPC ..... G03G 15/206; G03G 15/2064; G03G 15/2053
See application file for complete search history.

(56) References Cited

U.S. PATENT DOCUMENTS

2014/0138372 A1* 5/2014 Ogura ..... G03G 15/2042 219/216
2014/0219673 A1* 8/2014 Yamamoto ..... G03G 15/2042 399/69
2019/0278206 A1 9/2019 Adachi et al.
2019/0286026 A1 9/2019 Furuichi et al.
2019/0286028 A1 9/2019 Furuichi et al.
2019/0286029 A1 9/2019 Adachi et al.

FOREIGN PATENT DOCUMENTS

JP 2010-218893 9/2010
JP 2016-114914 6/2016
JP 2017-173581 9/2017
(Continued)

OTHER PUBLICATIONS

U.S. Appl. No. 16/520,409, filed Jul. 24, 2019, Hiroshi Yoshinaga, et al.

(Continued)

*Primary Examiner* — Hoang X Ngo
(74) *Attorney, Agent, or Firm* — Oblon, McClelland, Maier & Neustadt, L.L.P.

(57) ABSTRACT

A fixing device includes a fixing belt that is endless and rotates in a rotation direction. A pressure rotator presses against the fixing belt to form a nip between the fixing belt and the pressure rotator. A heater is disposed opposite an inner circumferential surface of the fixing belt and heats the fixing belt. A contact member contacts the fixing belt partially in a longitudinal direction of the fixing belt. A holder holds the heater. The heater contacts the holder with a first contact amount in a first span in a longitudinal direction of the heater, where the contact member contacts the fixing belt. The heater contacts the holder with a second contact amount, that is greater than the first contact amount, in a second span in the longitudinal direction of the heater, where the contact member does not contact the fixing belt.

15 Claims, 21 Drawing Sheets

(56) References Cited

FOREIGN PATENT DOCUMENTS

JP 2018-017877 2/2018

OTHER PUBLICATIONS

U.S. Appl. No. 16/519,254, filed Jul. 23, 2019, Daisuke Inoue, et al.
U.S. Appl. No. 16/502,473, filed Jul. 3, 2019, Yuusuke Furuichi, et al.
U.S. Appl. No. 16/502,348, filed Jul. 3, 2019, Yuusuke Furuichi, et al.
U.S. Appl. No. 16/391,959, filed Apr. 23, 2019, Takamasa Hase, et al.
U.S. Appl. No. 16/451,512, filed Jun. 25, 2019, Tomoya Adachi, et al.

* cited by examiner

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-245340, filed on Dec. 27, 2018, in the Japan Patent Office, the entire disclosure of which is hereby incorporated by reference herein.

BACKGROUND

Technical Field

Exemplary aspects of the present disclosure relate to a fixing device and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device including a fixing belt and a pressure rotator, such as a pressure roller, disposed opposite the fixing belt. The pressure rotator contacts the fixing belt to form a nip therebetween. As a recording medium, such as a sheet, that bears an unfixed toner image is conveyed through the nip, the fixing belt and the pressure rotator fix the unfixed toner image on the recording medium under heat and pressure.

The fixing device further includes a heater that heats the fixing belt. The heater contacts an inner circumferential surface of the fixing belt in a longitudinal direction (e.g., a width direction) thereof. The heater heats the fixing belt to a predetermined fixing temperature. However, when other element of the fixing device draws heat from the fixing belt partially, the heater may heat the fixing belt with a heating amount that is uneven in the longitudinal direction of the fixing belt. Accordingly, the fixing belt may have an uneven temperature in the longitudinal direction thereof, causing variation in gloss of the toner image fixed on the recording medium and fixing failure. The fixing device may employ the fixing belt having a decreased thermal capacity as a fixing rotator to save energy and achieve high speed printing, causing uneven temperature of the fixing belt frequently.

SUMMARY

This specification describes below an improved fixing device. In one embodiment, the fixing device includes a fixing belt that is endless and rotates in a rotation direction. A pressure rotator presses against the fixing belt to form a nip between the fixing belt and the pressure rotator. A heater is disposed opposite an inner circumferential surface of the fixing belt and heats the fixing belt. A contact member contacts the fixing belt partially in a longitudinal direction of the fixing belt. A holder holds the heater. The heater contacts the holder with a first contact amount in a first span in a longitudinal direction of the heater, where the contact member contacts the fixing belt. The heater contacts the holder with a second contact amount, that is greater than the first contact amount, in a second span in the longitudinal direction of the heater, where the contact member does not contact the fixing belt.

This specification further describes an improved fixing device. In one embodiment, the fixing device includes a fixing belt that is endless and rotates in a rotation direction. A pressure rotator presses against the fixing belt. A heater is disposed opposite an inner circumferential surface of the fixing belt and heats the fixing belt. A holder holds the heater. The heater includes a first heat generator and a second heat generator arranged with the first heat generator in a longitudinal direction of the heater with a gap between the first heat generator and the second heat generator. The heater contacts the holder with a first contact amount in a first span in the longitudinal direction of the heater. The first span is disposed opposite the gap. The heater contacts the holder with a second contact amount, that is greater than the first contact amount, in a second span in the longitudinal direction of the heater. The second span is disposed opposite each of the first heat generator and the second heat generator.

This specification further describes an improved image forming apparatus. In one embodiment, the image forming apparatus includes an image bearer that bears an image and a fixing device that fixes the image on a recording medium. The fixing device includes a fixing belt that is endless and rotates in a rotation direction. A pressure rotator presses against the fixing belt to form a nip between the fixing belt and the pressure rotator. A heater is disposed opposite an inner circumferential surface of the fixing belt and heats the fixing belt. A contact member contacts the fixing belt partially in a longitudinal direction of the fixing belt. A holder holds the heater. The heater contacts the holder with a first contact amount in a first span in a longitudinal direction of the heater, where the contact member contacts the fixing belt. The heater contacts the holder with a second contact amount, that is greater than the first contact amount, in a second span in the longitudinal direction of the heater, where the contact member does not contact the fixing belt.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
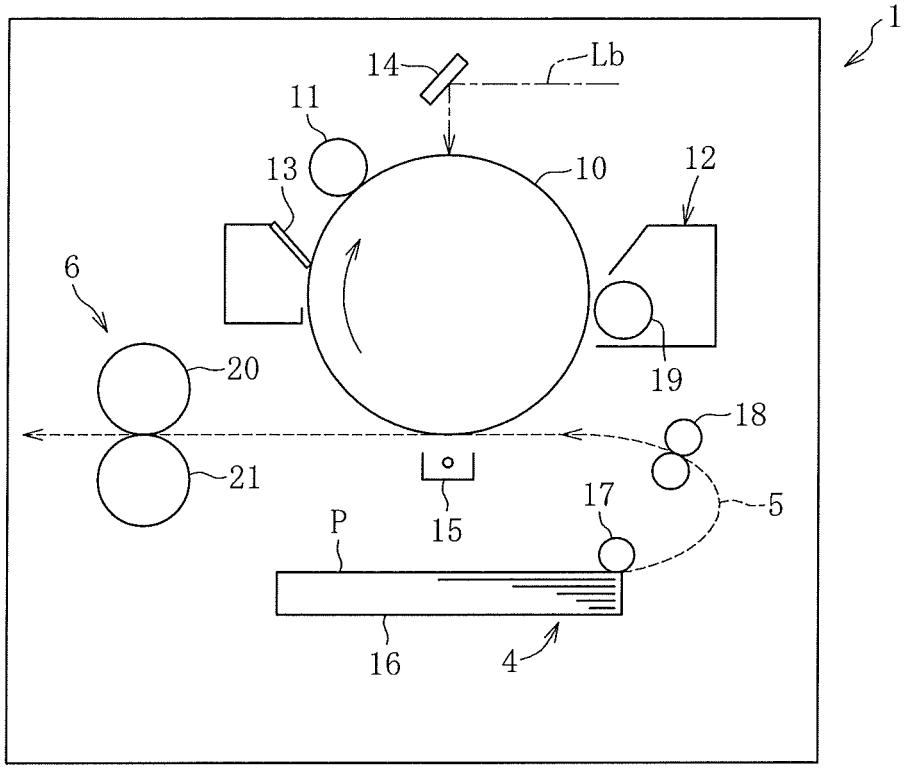
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 is explained.

Referring to the drawings, a description is provided of embodiments of the present disclosure. In the drawings, identical reference numerals are assigned to identical elements and equivalents and redundant descriptions of the identical elements and the equivalents are summarized or omitted properly.

As illustrated in FIG. 1, the image forming apparatus 1 is a monochrome image forming apparatus and includes a photoconductive drum 10 serving as an image bearer that bears an image (e.g., a toner image). The photoconductive drum 10 is a drum-shaped rotator that bears toner as a developer on a surface thereof. The photoconductive drum 10 rotates in a rotation direction indicated with an arrow. The photoconductive drum 10 is surrounded by a charging roller 11, a developing device 12, a cleaning blade 13, and the like. The charging roller 11 uniformly charges the surface of the photoconductive drum 10. The developing device 12 includes a developing roller 19 that supplies toner onto the surface of the photoconductive drum 10, forming a toner image thereon. The cleaning blade 13 cleans the surface of the photoconductive drum 10.

An exposure device is disposed above a process unit. The exposure device emits a laser beam Lb according to image data. The laser beam Lb irradiates the surface of the photoconductive drum 10 through a mirror 14.

A transfer device 15 including a transfer charger is disposed opposite the photoconductive drum 10. The transfer device 15 transfers the toner image formed on the surface of the photoconductive drum 10 onto a sheet P.

A sheet feeding device 4 is disposed in a lower portion of the image forming apparatus 1. The sheet feeding device 4 includes a sheet feeding tray 16 (e.g., a paper tray) and a sheet feeding roller 17. The sheet feeding tray 16 loads a plurality of sheets P serving as recording media. The sheet feeding roller 17 conveys a sheet P from the sheet feeding tray 16 to a conveyance path 5. A registration roller 18 is disposed downstream from the sheet feeding roller 17 in a sheet conveyance direction.

A fixing device 6 includes a fixing belt 20 heated by a heat source or a heater and a pressure roller 21 that presses against the fixing belt 20.

Referring to FIG. 1, a description is provided of a basic image forming operation performed by the image forming apparatus 1 having the construction described above.

As the image forming operation starts, the charging roller 11 charges the surface of the photoconductive drum 10. The exposure device emits a laser beam Lb according to image data, decreasing the electric potential of an irradiated portion on the surface of the photoconductive drum 10, which is irradiated with the laser beam Lb, and forming an electrostatic latent image on the photoconductive drum 10. The developing device 12 supplies toner to the electrostatic latent image formed on the surface of the photoconductive drum 10, visualizing the electrostatic latent image as a visible toner image (e.g., a developed image). The cleaning blade 13 removes toner and the like failed to be transferred onto the sheet P and therefore remained on the photoconductive drum 10 therefrom.

On the other hand, as the image forming operation starts, in the lower portion of the image forming apparatus 1, the sheet feeding roller 17 of the sheet feeding device 4 starts being driven and rotated, feeding a sheet P of the plurality of sheets P loaded in the sheet feeding tray 16 to the conveyance path 5.

The registration roller 18 conveys the sheet P sent to the conveyance path 5 to a transfer portion where the transfer device 15 is disposed opposite the photoconductive drum at a time when the toner image formed on the surface of the photoconductive drum 10 is disposed opposite the sheet P at the transfer portion. The transfer device 15 applies a transfer bias that transfers the toner image from the photoconductive drum 10 onto the sheet P.

The sheet P transferred with the toner image is conveyed to the fixing device 6 where the fixing belt 20 that is heated and the pressure roller 21 fix the toner image on the sheet P under heat and pressure. The sheet P fixed with the toner image is separated from the fixing belt 20 and conveyed by a conveying roller pair disposed downstream from the fixing device 6 in the sheet conveyance direction. The sheet P bearing the fixed toner image is ejected onto a sheet ejection tray disposed on an exterior of the image forming apparatus 1.

A description is provided of a construction of the fixing device 6.

Figure 2:
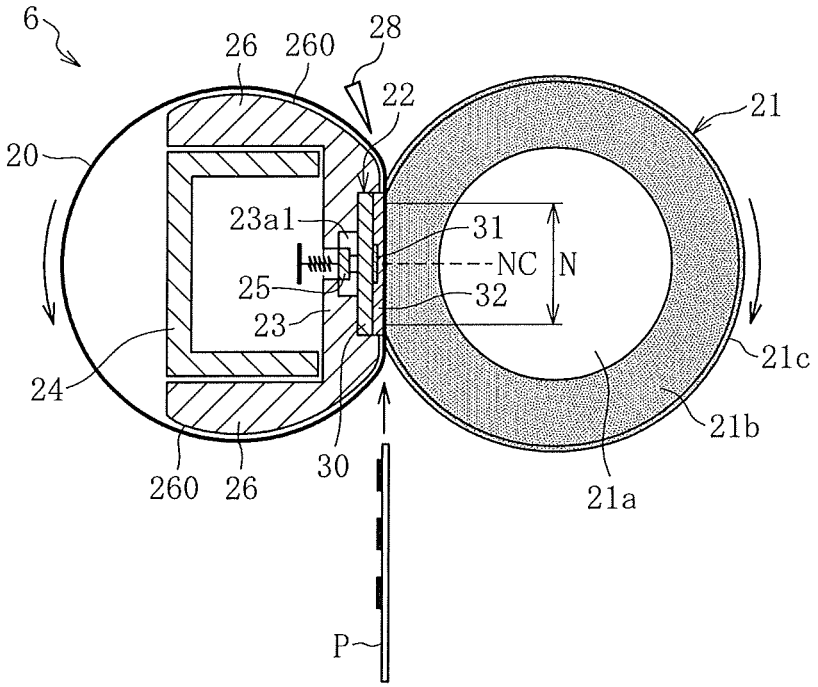
FIG. 2 is a schematic cross-sectional view of a fixing device incorporated in the image forming apparatus depicted in FIG. 1.

As illustrated in FIG. 2, the fixing device 6 according to this embodiment includes the fixing belt 20, the pressure roller 21, a heater 22, a heater holder 23, a stay 24, and a thermistor 25. The fixing belt 20 is an endless belt. The pressure roller 21 serves as a pressure rotator or a pressure member that contacts an outer circumferential surface of the fixing belt 20 to form a nip, that is, a fixing nip N, between the fixing belt 20 and the pressure roller 21. The heater 22 serves as a heater or a heating member that heats the fixing belt 20. The heater holder 23 serves as a holder that holds or supports the heater 22. The stay 24 serves as a support that supports the heater holder 23. The thermistor 25 serves as a temperature detector that detects the temperature of the fixing belt 20.

A detailed description is now given of a construction of the fixing belt 20.

The fixing belt 20 includes a tubular base that is made of polyimide (PI) and has an outer diameter of 25 mm and a thickness in a range of from 40 micrometers to 120 micrometers, for example. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 20 and facilitate separation of the sheet P and a foreign substance from the fixing belt 20. Optionally, an elastic layer that is made of rubber or the like and has a thickness in a range of from 50 micrometers to 500 micrometers may be interposed between the base and the release layer. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

A detailed description is now given of a construction of the pressure roller 21.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* is disposed on a surface of the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

A biasing member biases the pressure roller 21 toward the fixing belt 20, pressing the pressure roller 21 against the heater 22 via the fixing belt 20. Thus, the fixing nip N is formed between the fixing belt 20 and the pressure roller 21. A driver drives and rotates the pressure roller 21. As the pressure roller 21 rotates in a rotation direction indicated with an arrow in FIG. 2, the fixing belt 20 is driven and rotated by the pressure roller 21.

A detailed description is now given of a construction of the heater 22.

The heater 22 is a laminated heater that extends in a longitudinal direction thereof throughout an entire length of the fixing belt 20 in a longitudinal direction, that is, an axial direction, of the fixing belt 20. The longitudinal direction of the fixing belt 20 is perpendicular to a plane of paper in FIG. 2 and parallel to a longitudinal direction of the heater 22 and the heater holder 23. The heater 22 includes a base 30 that is platy, a resistive heat generator 31 serving as a heat generator that is disposed on the base 30, and an insulating layer 32 that coats the resistive heat generator 31. The insulating layer 32 of the heater 22 contacts the inner circumferential surface of the fixing belt 20. Heat generated by the resistive heat generator 31 is conducted to the fixing belt 20 through the insulating layer 32.

A detailed description is now given of a construction of the heater holder 23 and the stay 24.

The heater holder 23 and the stay 24 are disposed inside a loop formed by the fixing belt 20. The stay 24 includes a channel made of metal. Both lateral ends of the stay 24 in a longitudinal direction thereof are supported by side plates of the fixing device 6, respectively. Since the stay 24 supports the heater holder 23 and the heater 22 supported by the heater holder 23, in a state in which the pressure roller 21 is pressed against the fixing belt 20, the heater 22 receives pressure from the pressure roller 21 precisely to form the fixing nip N stably.

Since the heater holder 23 is subject to high temperatures by heat from the heater 22, the heater holder 23 is preferably made of a heat resistant material. For example, if the heater holder 23 is made of heat resistant resin having a decreased thermal conductivity, such as liquid crystal polymer (LCP), the heater holder 23 suppresses conduction of heat thereto from the heater 22, facilitating heating of the fixing belt 20. In order to decrease a contact area where the heater holder 23 contacts the heater 22 and thereby reduce an amount of heat conducted from the heater 22 to the heater holder 23, the heater holder 23 includes a recess 23*a*1 disposed at a center of the heater holder 23 in a short direction thereof (e.g., a vertical direction in FIG. 2). The recess 23*a*1 produces a clearance between the heater holder 23 and the base 30 to decrease a contact area where the heater holder 23 contacts the base 30. The recess 23*a*1 decreases an amount of heat conducted from the heater 22 to the heater holder 23, causing the heater 22 to heat the fixing belt 20 effectively. Additionally, according to this embodiment, the recess 23*a*1 of the heater holder 23 is disposed opposite the resistive heat generator 31 via the base 30, thus decreasing the amount of heat conducted to the heater holder 23 further and allowing the heater 22 to heat the fixing belt 20 effectively.

Figure 3A:
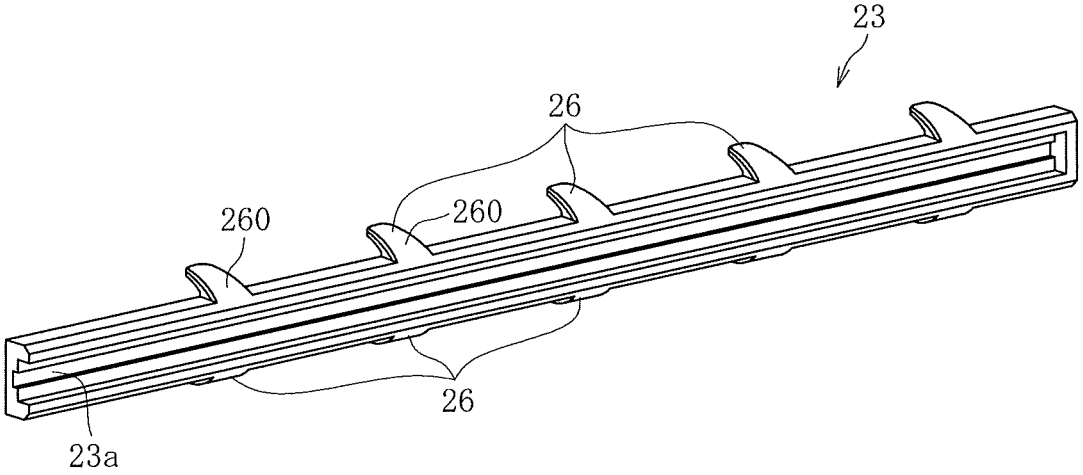
FIG. 3A is a perspective view of a heater holder incorporated in the fixing device depicted in FIG. 2.
Figure 3B:
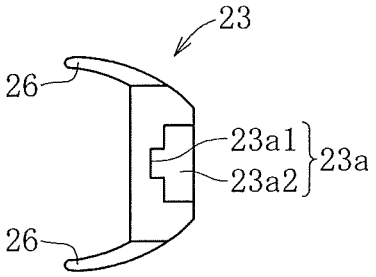
FIG. 3B is a left side view of the heater holder depicted in FIG. 3A.

The heater holder 23 mounts a plurality of guides 26 serving as contact members that guide the fixing belt 20. The guides 26 are disposed upstream from and below the heater 22 in FIG. 2 and downstream from and above the heater 22 in FIG. 2, respectively, in a rotation direction of the fixing belt 20. As illustrated in FIGS. 3A and 3B, the plurality of guides 26 disposed upstream and downstream from the heater 22 in the rotation direction of the fixing belt 20 is aligned in the longitudinal direction of the heater 22 with a clearance between adjacent ones of the guides 26. Each of the guides 26 is substantially fan-shaped. As illustrated in FIG. 2, each of the guides 26 includes a belt opposing face 260 that is disposed opposite the inner circumferential surface of the fixing belt 20 and defines an arc or a projecting curved face that extends in a circumferential direction of the fixing belt 20.

As illustrated in FIG. 3B, the heater holder 23 includes a depression 23*a* disposed opposite the fixing belt 20. The depression 23*a* includes a first step disposed at a center of the depression 23*a* and a second step disposed at each end of the depression 23*a* in the short direction of the heater holder 23. The first step defines a first depth and the second step has a second depth different from the first depth. The first step that is disposed at the center of the depression 23*a* in the short direction of the heater holder 23 and defines the first depth greater than the second depth defines a deep groove, that is, the recess 23*a*1 described above. A clearance that is disposed above the recess 23*a*1 and is substantially rectangular in cross section defines a mount 23*a*2 to which the heater 22 is attached.

Figure 4A:
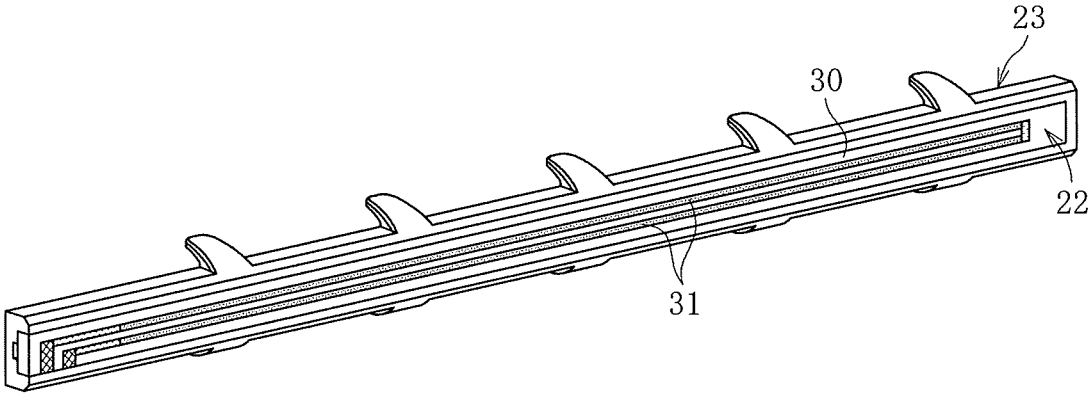
FIG. 4A is a perspective view of the heater holder depicted in FIG. 3A and a heater incorporated in the fixing device depicted in FIG. 2, illustrating the heater attached to the heater holder.
Figure 4B:
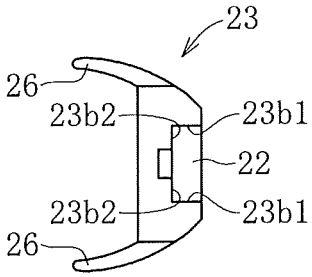
FIG. 4B is a left side view of the heater holder and the heater depicted in FIG. 4A.

As illustrated in FIGS. 3A, 3B, 4A, and 4B, as the heater 22 is fitted into the mount 23*a*2, the heater 22 is held by the heater holder 23. As illustrated in FIG. 4B, the heater holder 23 includes vertical faces 23*b*1 (e.g., side faces) and horizontal faces 23*b*2 (e.g., bottom faces) that contact the heater 22. The pressure roller 21 depicted in FIG. 2 presses the heater 22 and the heater holder 23 leftward in FIG. 4B. The horizontal faces 23*b*2 of the heater holder 23 contact the heater 22, thus serving as reception faces that receive pressure from the pressure roller 21.

As illustrated in FIG. 4A, the resistive heat generators 31 of the heater 22 are mounted on a surface of the base 30 and extended in the longitudinal direction of the heater 22. As the resistive heat generators 31 generate heat, the heater 22 heats the fixing belt 20. FIG. 4A does not illustrate the insulating layer 32. Although the heater holder 23 according to this embodiment includes notches described below, FIG. 4A does not illustrate the notches. The construction of each of the heater holder 23 and the heater 22 is described below in more detail.

As illustrated in FIG. 2, in the fixing device 6 according to this embodiment, when printing starts, the driver drives and rotates the pressure roller 21 and the fixing belt 20 starts rotation in accordance with rotation of the pressure roller 21. Since the inner circumferential surface of the fixing belt 20 is contacted and guided by the belt opposing face 260 of each of the guides 26, the fixing belt 20 rotates stably and smoothly. Additionally, as power is supplied to the resistive heat generators 31 of the heater 22, the heater 22 heats the fixing belt 20. In a state in which the temperature of the fixing belt 20 reaches a predetermined target temperature (e.g., a fixing temperature), as a sheet P bearing an unfixed toner image is conveyed through the fixing nip N formed between the fixing belt 20 and the pressure roller 21 as illustrated in FIG. 2, the fixing belt 20 and the pressure roller 21 fix the unfixed toner image on the sheet P under heat and pressure.

A description is provided of the construction of the heater 22 in more detail.

Figure 5A:
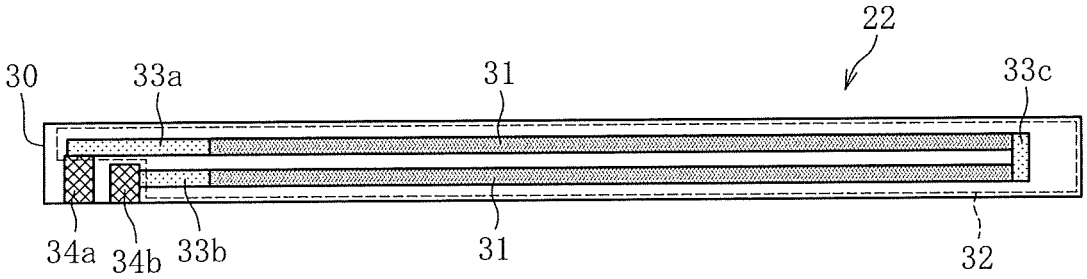
FIG. 5A is a front view of the heater depicted in FIG. 4A, that incorporates resistive heat generators connected in series.
Figure 5B:
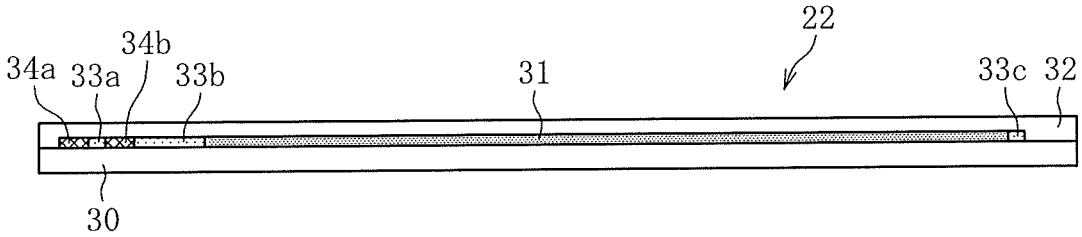
FIG. 5B is a bottom view of the heater depicted in FIG. 5A.
Figure 6A:
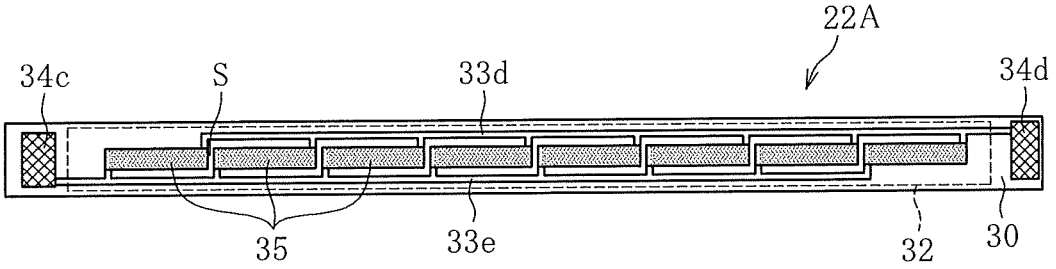
FIG. 6A is a front view of a heater installable in the fixing device depicted in FIG. 2, that incorporates resistive heat generators connected in parallel as a first example.
Figure 6B:
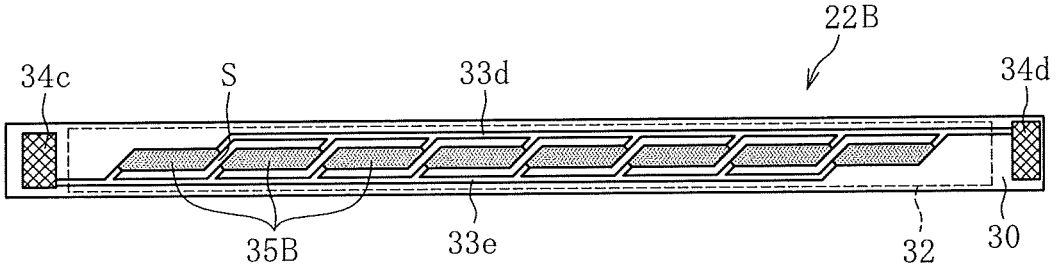
FIG. 6B is a front view of a heater installable in the fixing device depicted in FIG. 2, that incorporates resistive heat generators connected in parallel as a second example.
Figure 6C:
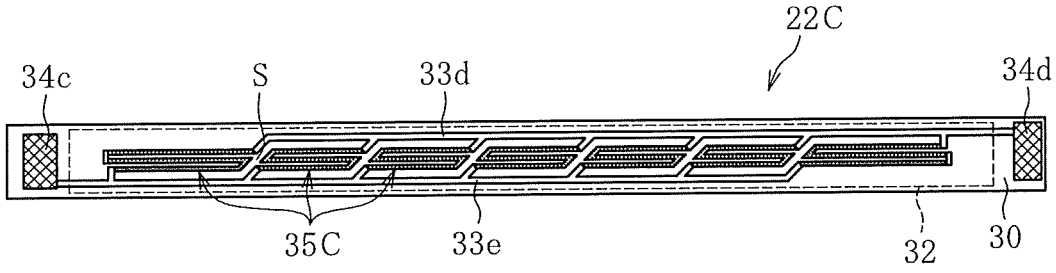
FIG. 6C is a front view of a heater installable in the fixing device depicted in FIG. 2, that incorporates resistive heat generators connected in parallel as a third example.

As constructions of heaters according to the embodiments of the present disclosure, the following describes a construction of the heater 22 including the resistive heat generators 31 connected in series as illustrated in FIGS. 5A and 5B and a construction of each of a heater 22A incorporating resistive heat generators 35 connected in parallel, a heater 22B incorporating resistive heat generators 35B connected in parallel, and a heater 22C incorporating resistive heat generators 35C connected in parallel as illustrated in FIGS. 6A, 6B, and 6C, respectively.

As illustrated in FIGS. 5A and 5B, the surface of the base 30, that is, an elongate plate, mounts the resistive heat generators 31, feeders 33*a*, 33*b*, and 33*c*, electrodes 34*a* and 34*b*, and the like. The resistive heat generators 31 are arranged in two lines and extended in the longitudinal direction of the heater 22. The insulating layer 32 covers and insulates the surface of the base 30, the resistive heat generators 31, the feeders 33*a*, 33*b*, and 33*c*, and the electrodes 34*a* and 34*b*.

The base 30 is preferably made of ceramic (e.g., alumina and aluminum nitride), glass, mica, or heat resistant resin (e.g., P1) which has an increased heat resistance and an increased insulation. Alternatively, the base 30 may include a conductive layer made of a conductive material and an insulating layer made of the insulating material described above and disposed on the conductive layer. For example, as the conductive material, a material having an increased thermal conductivity such as aluminum, copper, silver, graphite, and graphene is preferably used. The material having the increased thermal conductivity evens the temperature of an entirety of the heater 22 by thermal conduction, improving quality of a toner image fixed on a sheet P.

The resistive heat generators 31 and the feeders 33*a*, 33*b*, and 33*c* are produced as below. Silver (Ag), palladium (Pd), platinum (Pt), ruthenium oxide ($RuO_2$), and the like are mixed into paste made of a conductive material. The paste coats the base 30 by screen printing or the like. Thereafter, the base 30 is subject to firing.

The insulating layer 32 is preferably made of ceramic (e.g., alumina and aluminum nitride), glass, mica, or heat resistant resin (e.g., polyimide), which improves heat resistance and insulation of the insulating layer 32.

The resistive heat generators 31 are connected to the electrodes 34*a* and 34*b* through the feeders 33*a* and 33*b*, respectively, at one lateral end of each of the resistive heat generators 31 in the longitudinal direction of the heater 22. The resistive heat generators 31 are connected to each other through the feeder 33*c* extending in a short direction of the heater 22 at another lateral end of each of the resistive heat generators 31 in the longitudinal direction of the heater 22. The insulating layer 32 covers the base 30, the resistive heat generators 31, the feeders 33*a*, 33*b*, and 33*c*, and the electrodes 34*a* and 34*b*.

Referring to FIGS. 6A, 6B, and 6C, a description is provided of the construction of each of the heaters 22A, 22B, and 22C incorporating the resistive heat generators 35, 35B, and 35C connected in parallel, respectively.

As illustrated in FIG. 6A, the base 30 mounts the plurality of resistive heat generators 35, that is, eight resistive heat generators 35 according to this embodiment. The resistive heat generators 35 serving as heat generators are arranged in a longitudinal direction of the heater 22A. Feeders 33*d* and 33*e* are disposed at both ends of the base 30, respectively, in a short direction thereof. Both lateral ends of each of the resistive heat generators 35 in a longitudinal direction of the base 30 are coupled to the feeders 33*d* and 33*e*, respectively. The resistive heat generators 35 are connected in parallel. The feeders 33*d* and 33*e* are coupled to electrodes 34*d* and 34*c*, respectively, at one lateral end of each of the feeders 33*d* and 33*e* in the longitudinal direction of the heater 22A.

According to this embodiment, each of the resistive heat generators 35 is made of a material having a positive temperature coefficient of resistance (TCR) that is characterized in that, as the temperature of the resistive heat generators 35 increases, the electric resistance value thereof increases, decreasing the output of the heater 22A in portions thereof where the resistive heat generators 35 are disposed.

Like the resistive heat generators 31 described above, the resistive heat generators 35 are produced as below. Silver (Ag), palladium (Pd), platinum (Pt), ruthenium oxide ($RuO_2$), and the like are mixed into paste made of a conductive material. The paste coats the base 30 by screen printing or the like. Thereafter, the base 30 is subject to firing.

According to the embodiments of the present disclosure, when a small sheet P having a small width in the longitudinal direction of the fixing belt 20 is conveyed through the fixing device 6, the small sheet P does not draw heat from both lateral ends of the fixing belt 20 in the longitudinal direction thereof and the resistive heat generators 35 disposed opposite both lateral ends of the fixing belt 20. Accordingly, both lateral ends of the fixing belt 20 in the longitudinal direction thereof and the resistive heat generators 35 disposed opposite both lateral ends of the fixing belt 20 suffer from relatively high temperatures and relatively high resistance values. Since a constant voltage is applied to the resistive heat generators 35, an output from the resistive heat generators 35 disposed opposite both lateral ends of the fixing belt 20 in the longitudinal direction thereof decreases relatively, decreasing an amount of heat generated by the resistive heat generators 35. Thus, the resistive heat generators 35 suppress an amount of heat generated by the heater 22A in a non-conveyance span where the small sheet P is not conveyed, preventing overheating of the fixing belt 20 in the non-conveyance span.

Conversely, for example, the heater 22 incorporating the resistive heat generators 31 connected in series as illustrated in FIGS. 5A and 5B may prevent overheating of both lateral ends of the fixing belt 20 in the longitudinal direction thereof by decreasing print speed. However, the heater 22A incorporating the resistive heat generators 35 connected in parallel prevents overheating of the fixing belt 20 while suppressing decrease in print speed.

As illustrated in FIG. 6B, each of the resistive heat generators 35B is inclined into substantially a parallelogram. With the resistive heat generators 35 that are substantially rectangular as illustrated in FIG. 6A, a heat generation amount of the heater 22A at a gap S between adjacent ones of the resistive heat generators 35 decreases substantially compared to a portion of the heater 22A other than the gap S in the longitudinal direction of the heater 22A, causing uneven temperature of the fixing belt 20. Conversely, according to the embodiment illustrated in FIG. 6B, adjacent ones of the resistive heat generators 35B, each of which is substantially the parallelogram, overlap in a longitudinal direction of the heater 22B, suppressing uneven temperature of the fixing belt 20.

As illustrated in FIG. 6C, each of the resistive heat generators 35C is an elongate linear portion that is bent and turned into a serpentine shape. Since the resistive heat generators 35C are elongated, even if the resistive heat generators 35C are made of a material that has a low resistance value and is available at reduced costs, the resistive heat generators 35C achieve a desired heat generation amount, reducing manufacturing costs of the heater 22C.

As described above, a heater (e.g., the heater 22) incorporating resistive heat generators (e.g., the resistive heat generators 31) connected in series or a heater (e.g., the heaters 22A, 22B, and 22C) incorporating resistive heat generators (e.g., the resistive heat generators 35, 35B, and 35C) connected in parallel is employed as a heater according to the embodiments of the present disclosure. The following describes the construction of the heater 22 depicted in FIGS. 5A and 5B, that incorporates the resistive heat generators 31 connected in series as one example.

Figure 7:
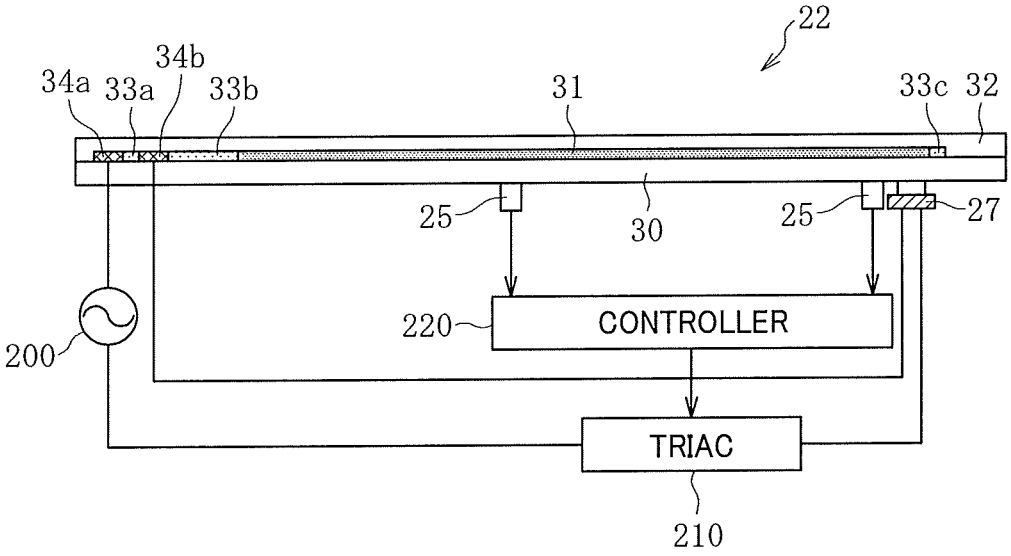
FIG. 7 is a diagram of the heater depicted in FIG. 4A, illustrating a power supply circuit that supplies power to the heater.

As illustrated in FIG. 7, according to the embodiments, a power supply circuit for supplying power to each of the resistive heat generators 31 is constructed by electrically connecting an alternating current power supply 200 to the electrodes 34*a* and 34*b* of the heater 22. The power supply circuit includes a triac 210 that controls an amount of power supplied to each of the resistive heat generators 31. A controller 220 includes a microcomputer that includes a central processing unit (CPU), a read-only memory (ROM), a random access memory (RAM), and an input-output (I/O) interface.

According to the embodiments, the thermistors 25 serving as temperature detectors are disposed opposite a center span of the heater 22 in the longitudinal direction thereof, that is, a minimum sheet conveyance span where a minimum size sheet P is conveyed, and one lateral end span of the heater 22 in the longitudinal direction thereof, respectively. Further, a thermostat 27 serving as a power interrupter is disposed opposite one lateral end of the heater 22 in the longitudinal direction thereof. The thermostat 27 interrupts supplying power to the resistive heat generators 31 when a temperature of the resistive heat generators 31 is a predetermined temperature or higher. The thermistors 25 and the thermostat 27 contact a back face of the base 30, that is opposite a front face of the base 30, that mounts the resistive heat generators 31. The thermistors 25 and the thermostat 27 detect the temperature of the resistive heat generators 31.

The controller 220 controls the amount of power supplied to each of the resistive heat generators 31 through the triac 210 based on temperatures of the resistive heat generators 31, that are detected by the thermistors 25, respectively. When a sheet P is conveyed to the fixing device 6, the controller 220 determines the amount of power supplied to each of the resistive heat generators 31 by considering an amount of heat drawn by the sheet P.

Figure 8:
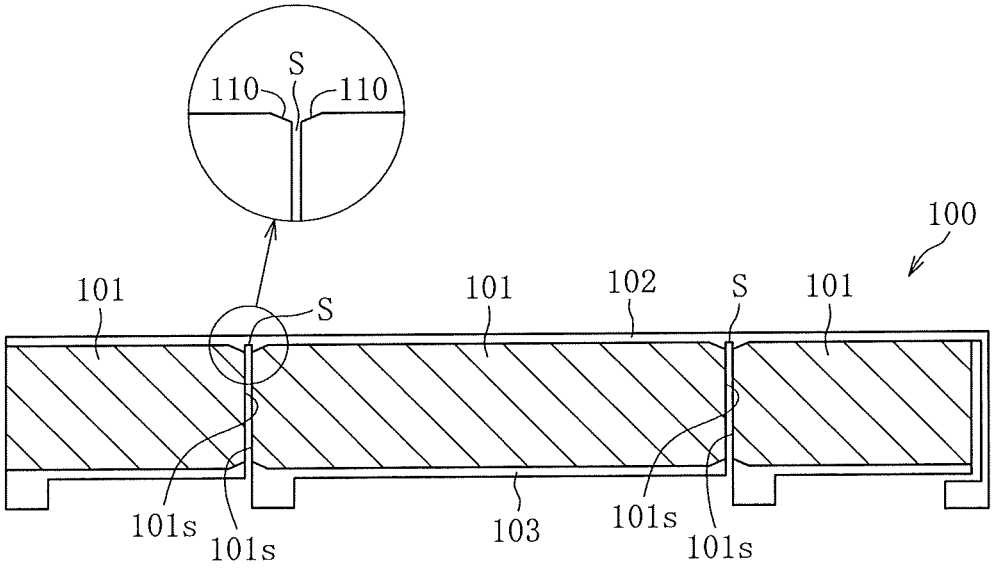
FIG. 8 is a diagram of a heater according to a comparative example.

Referring to FIG. 8, a description is provided of a construction of a heater 100 according to a comparative example.

As illustrated in FIG. 8, the heater 100 includes a plurality of resistive heat generators 101 and a plurality of feeders 102 and 103. The resistive heat generators 101 are separated from each other in a longitudinal direction of the heater 100 (e.g., a horizontal direction in FIG. 8). The feeders 102 and 103 sandwich the resistive heat generators 101 in a short direction of the heater 100 and extend in the longitudinal direction of the heater 100.

As illustrated in an enlarged view in FIG. 8, a notch 110 is disposed on an edge 101*s* of the resistive heat generator 101. The edge 101*s* is disposed at a lateral end of the resistive heat generator 101 in a longitudinal direction thereof. The edge 101*s* of one of the resistive heat generators 101 is adjacent to the edge 101*s* of another one of the resistive heat generators 101. The notch 110 decreases a width of the resistive heat generator 101 in a short direction thereof toward the edge 101*s* in the longitudinal direction of the resistive heat generator 101.

With the construction of the heater 100 incorporating the plurality of resistive heat generators 101 that is separated from each other in the longitudinal direction of the heater 100, the heater 100 generates a decreased amount of heat at a gap S (e.g., a slit) between the resistive heat generators 101. However, the notch 110 disposed at the edge 101*s* defines a notch portion of the resistive heat generator 101 where the notch 110 is disposed. The notch 110 decreases the resistance value of the notch portion of the resistive heat generator 101 per unit length in the longitudinal direction thereof. Accordingly, the notch 110 increases the heat generation amount of the notch portion of the resistive heat generator 101, decreasing difference in the heat generation amount of the heater 100 in the longitudinal direction thereof and thereby suppressing uneven temperature of a fixing belt.

However, the notch portion of the resistive heat generator 101, that has a decreased width, may suffer from decrease in mechanical strength due to partial breakage of a pattern and the like. Hence, the construction of the heater 100 may not be advantageous. To address this circumstance, a construction that prevents uneven temperature of the fixing belt in a longitudinal direction thereof is requested instead of the construction of the heater 100.

A description is provided of various embodiments of the present disclosure successively.

Advantages achieved by the embodiments are also described. A construction peculiar to each of the embodiments is mainly described and a description of a construction common to the embodiments is omitted properly.

Figure 9A:
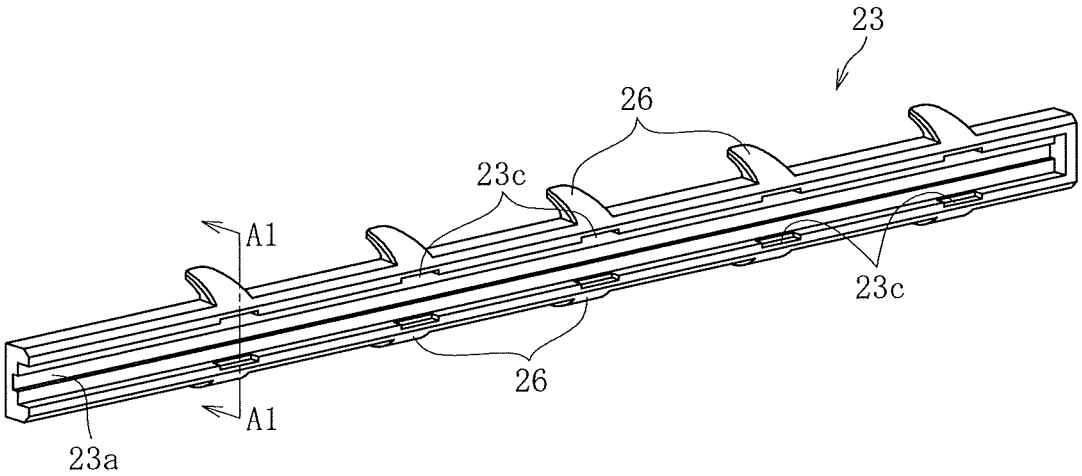
FIG. 9A is a perspective view of the heater holder depicted in FIG. 3A according to a first embodiment of the present disclosure.
Figure 9B:
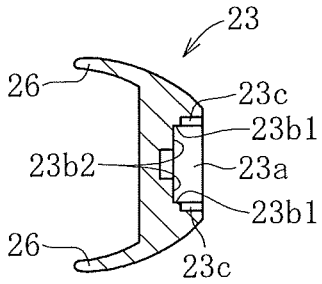
FIG. 9B is a cross-sectional view of the heater holder depicted in FIG. 9A taken on line A1-A1 in FIG. 9A.

Referring to FIGS. 9A and 9B, a description is provided of a construction of the heater holder 23 according to a first embodiment of the present disclosure.

As illustrated in FIGS. 9A and 9B, the heater holder 23 includes notches 23*c* each of which is disposed in the vertical face 23*b*1 at a position, that is, in a span, in the longitudinal direction of the heater holder 23, where the guide 26 contacts the fixing belt 20. According to this embodiment, the position or the span in the longitudinal direction of the heater holder 23, where the guide 26 contacts the fixing belt 20, is substantially identical to a position or a span of the guide 26 in the longitudinal direction of the heater holder 23. Hence, alternatively, the position or the span of the notch 23*c* may be hereinafter referred to as the position or the span of the guide 26.

FIG. 9A is a perspective view of the heater holder 23. FIG. 9B is a cross-sectional view of the heater holder 23 taken on line A1-A1 in FIG. 9A. The notch 23*c* according to this embodiment has widths in the short direction perpendicular to the longitudinal direction of the heater holder 23, that is, lengths in a horizontal direction in FIG. 9B, which are substantially equal, thus defining a rectangle in cross section.

Figure 10A:
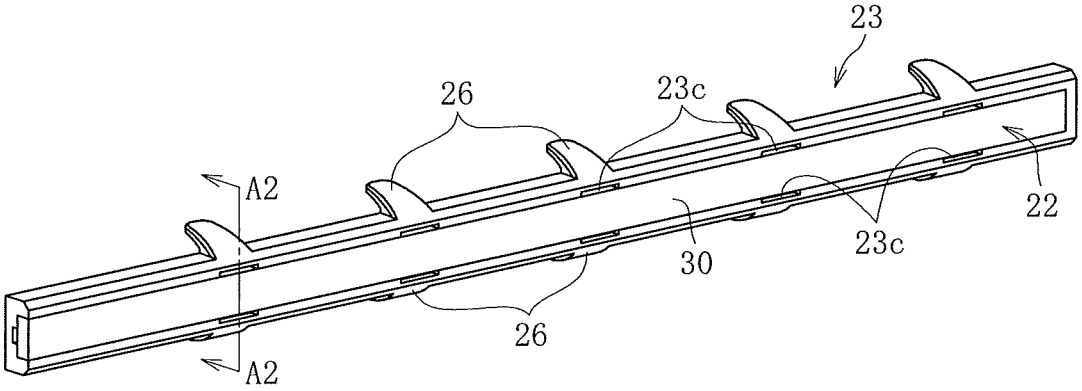
FIG. 10A is a perspective view of the heater holder depicted in FIG. 9A, that holds the heater depicted in FIG. 4A.
Figure 10B:
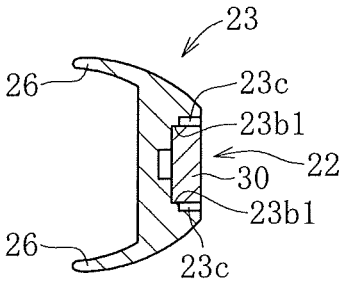
FIG. 10B is a cross-sectional view of the heater holder depicted in FIG. 10A taken on line A2-A2 in FIG. 10A.

FIG. 10A is a perspective view of the heater holder 23 and the heater 22. FIG. 10B is a cross-sectional view of the heater holder 23 and the heater 22 taken on line A2-A2 in FIG. 10A. As illustrated in FIGS. 10A and 10B, at positions or in spans in the longitudinal direction of the heater 22, where the guides 26 are disposed, respectively, the notches 23*c* separate the heater 22 from the heater holder 23. Accordingly, the heater 22 contacts the vertical faces 23*b*1 of the heater holder 23 with a decreased contact amount or a decreased contact area. According to this embodiment and each of embodiments described below, a contact amount with which the heater 22 contacts the heater holder 23 denotes a contact length with which the heater 22 contacts the heater holder 23 in a cross section at a predetermined position in the longitudinal direction of the heater 22.

The contact amount with which the heater 22 contacts the heater holder 23 may be hereinafter referred to as the contact amount briefly. FIGS. 10A and 10B illustrate the base of the heater 22 and do not illustrate other elements of the heater 22. Drawings subsequent to FIGS. 10A and 10B also illustrate elements of the heater 22, that are extracted properly as needed.

Figure 11:
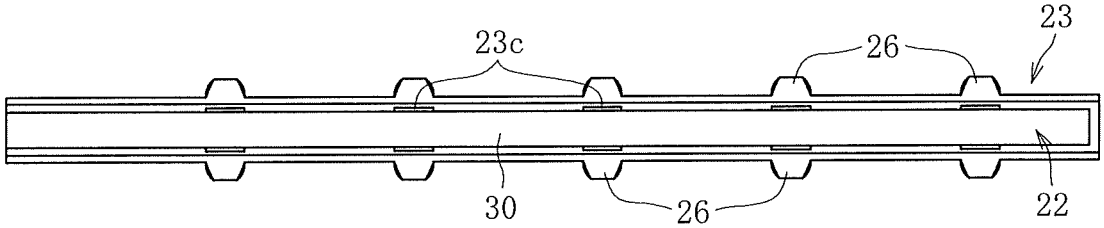
FIG. 11 is a diagram illustrating a front view of the heater holder depicted in FIG. 10A, that holds the heater, and a temperature distribution of a fixing belt in a longitudinal direction thereof, that is incorporated in the fixing device depicted in FIG. 2.
Figure 11:
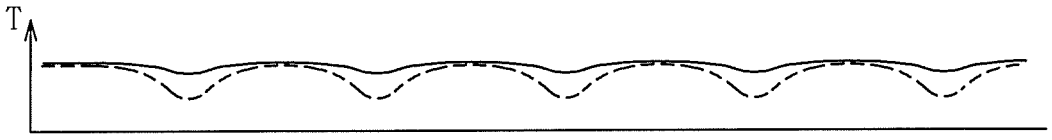

FIG. 11 is a diagram illustrating a distribution of a surface temperature T of the fixing belt 20 in the longitudinal direction of the heater 22. A horizontal axis represents the longitudinal direction of the heater 22. A vertical axis represents the surface temperature T. A dotted line represents a distribution of the surface temperature T with a construction of a heater holder, that is different from the construction of the heater holder 23 according to this embodiment, for example, the construction of the heater holder that does not incorporate a notch and contacts a heater with a contact amount that is substantially even in a longitudinal direction of the heater. A solid line represents a distribution of the surface temperature T with the construction of the heater holder 23 according to this embodiment.

At the position or in the span in the longitudinal direction of the heater 22, where the guide 26 is disposed, the guide 26 contacts the fixing belt 20 and draws heat from the fixing belt 20, decreasing the surface temperature T of the fixing belt 20. Accordingly, as illustrated with the dotted line in FIG. 11, the fixing belt 20 may suffer from uneven temperature in the longitudinal direction thereof.

To address this circumstance, according to this embodiment, as described above, the heater holder 23 includes the notches 23*c* disposed at the positions or in the spans in the longitudinal direction of the heater 22, where the guides 26 are disposed, respectively. That is, the notches 23*c* are disposed opposite the guides 26, respectively. The notches 23*c* cause the heater 22 to contact the heater holder 23 with the decreased contact amount or the decreased contact area. The notches 23*c* decrease an amount of heat conducted from the heater 22 to the heater holder 23, allowing the heater 22 to heat the fixing belt 20 effectively at the positions or in the spans where the guides 26 are disposed, respectively. Accordingly, as illustrated with the solid line in FIG. 11, the temperature of the fixing belt 20 increases at the positions or in the spans where the guides 26 are disposed, respectively, suppressing uneven temperature of the fixing belt 20 in the longitudinal direction thereof. Consequently, the fixing belt 20 prevents variation in gloss of a toner image formed on a sheet P and failure in fixing the toner image on the sheet P.

Additionally, according to this embodiment, as illustrated in FIG. 9B, the notch 23*c* is disposed in the vertical face 23*b*1, decreasing the contact amount with which the heater 22 contacts the heater holder 23 without decreasing the contact amount with which the heater 22 contacts the horizontal faces 23*b*2 of the heater holder 23. As described above, the horizontal faces 23*b*2 serve as the reception faces that receive pressure from the pressure roller 21 depicted in FIG. 2. Hence, the contact amount with which the heater 22 contacts the horizontal faces 23*b*2 is ensured, improving mechanical strength of the heater holder 23.

Figure 12A:
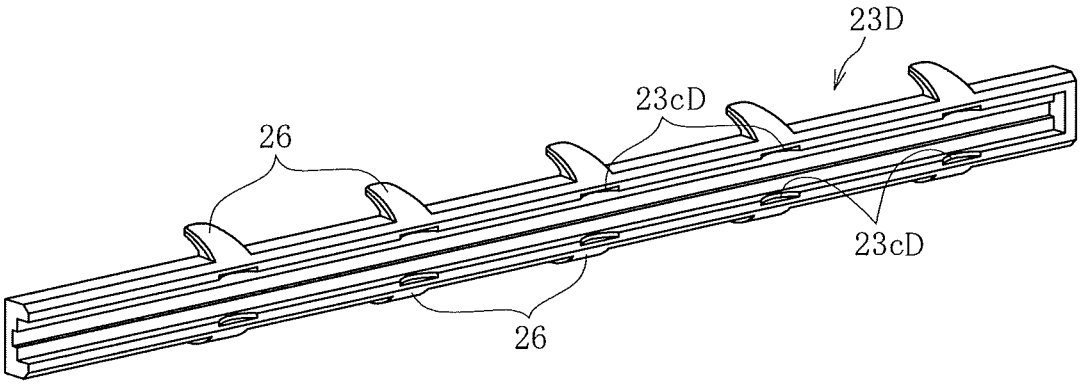
FIG. 12A is a perspective view of a heater holder according to a second embodiment of the present disclosure, that is installable in the fixing device depicted in FIG. 2.
Figure 12B:
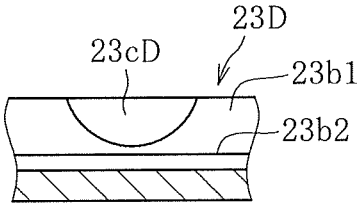
FIG. 12B is a diagram of the heater holder depicted in FIG. 12A, illustrating a shape of a notch incorporated in the heater holder.

Referring to FIGS. 12A and 12B, a description is provided of a construction of a heater holder 23D according to a second embodiment of the present disclosure, that is installable in the fixing device 6.

As illustrated in FIGS. 12A and 12B, the heater holder 23D includes notches 23*c*D. A length of the notch 23*c*D in a short direction thereof (e.g., a length in a vertical direction in FIG. 12B) increases toward a center of the notch 23*c*D in a longitudinal direction thereof. Thus, the notch 23*c*D defines substantially an arc in cross section.

As illustrated in FIG. 11, the surface temperature T of the fixing belt 20 decreases at the positions or in the spans where the guides 26 contact the fixing belt 20, respectively. For example, the surface temperature T of the fixing belt 20 is lowest at a center of each of the guides 26 in a longitudinal direction thereof. To address this circumstance, according to this embodiment, the notch 23*c*D is substantially the arc, decreasing the contact amount with which the heater 22 contacts the heater holder 23D in accordance with decrease in the surface temperature T of the fixing belt 20. That is, the notch 23*c*D has a shape corresponding to the distribution of the surface temperature T of the fixing belt 20 more precisely, suppressing uneven temperature of the fixing belt 20 more effectively.

Figure 13:
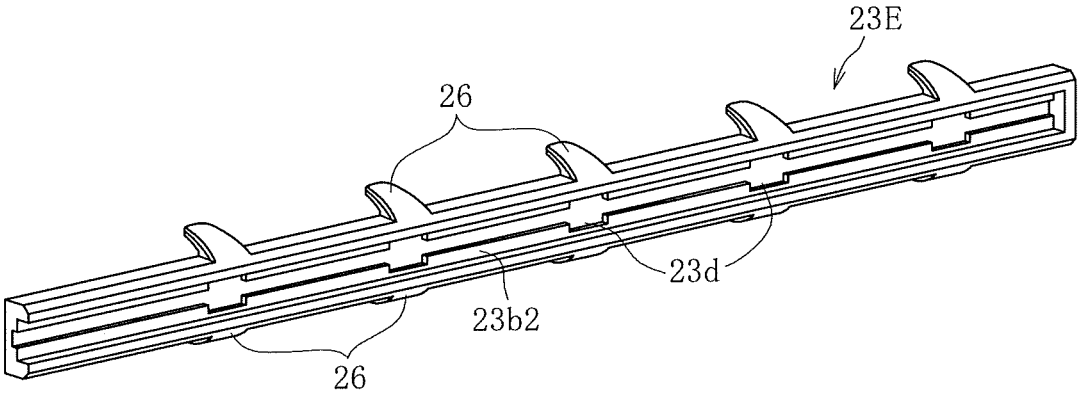
FIG. 13 is a perspective view of a heater holder according to a third embodiment of the present disclosure, that is installable in the fixing device depicted in FIG. 2.
Figure 14:
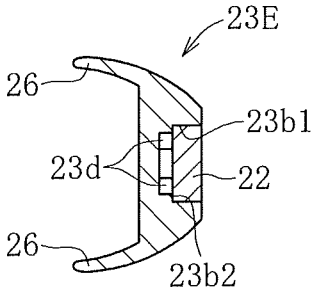
FIG. 14 is a cross-sectional view of the heater holder depicted in FIG. 13 and the heater held by the heater holder.

Referring to FIGS. 13 and 14, a description is provided of a construction of a heater holder 23E according to a third embodiment of the present disclosure, that is installable in the fixing device 6.

As illustrated in FIG. 13, the heater holder 23E includes notches 23*d* disposed in the horizontal faces 23*b*2 at positions or in spans in a longitudinal direction of the heater holder 23E, where the guides 26 are disposed, respectively. For example, the notches 23*d* are disposed opposite the guides 26, respectively.

As illustrated in FIG. 14, also in a cross section where the notch 23*d* is disposed, a part of each of the horizontal faces 23*b*2 remains and contacts the heater 22. Since the horizontal faces 23*b*2 also serve as the reception faces that receive pressure from the pressure roller 21, a part of each of the horizontal faces 23*b*2 that remains serves as the reception face that receives pressure from the pressure roller 21. According to this embodiment, a width of the notch 23*d* in a thickness direction of the heater holder 23E (e.g., a length in a vertical direction in FIG. 14), that is perpendicular to the longitudinal direction of the heater holder 23E, is substantially constant. Thus, the notch 23*d* is substantially rectangular in cross section.

Figure 15:
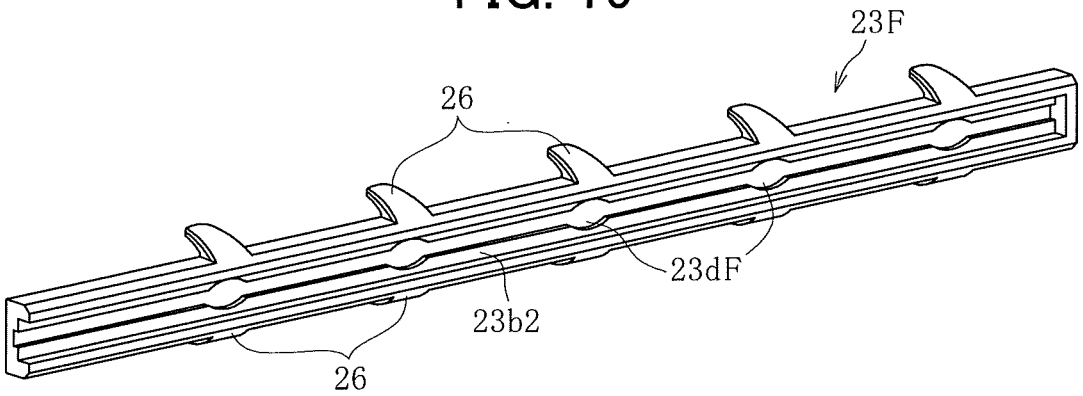
FIG. 15 is a perspective view of a heater holder according to a fourth embodiment of the present disclosure, that is installable in the fixing device depicted in FIG. 2.

Referring to FIG. 15, a description is provided of a construction of a heater holder 23F according to a fourth embodiment of the present disclosure, that is installable in the fixing device 6.

As illustrated in FIG. 15, like the heater holder 23E according to the third embodiment, the heater holder 23F according to the fourth embodiment includes notches 23*d*F disposed in the horizontal faces 23*b*2 at positions or in spans in a longitudinal direction of the heater holder 23F, where the guides 26 are disposed, respectively. For example, the notches 23*d*F are disposed opposite the guides 26, respectively. According to this embodiment, a width of the notch 23*d*F in a thickness direction thereof increases toward a center of the notch 23*d*F in a longitudinal direction thereof. Thus, the notch 23*d*F defines substantially an arc in cross section. Like the horizontal faces 23*b*2 of the heater holder 23E depicted in FIG. 14, a part of each of the horizontal faces 23*b*2 of the heater holder 23F depicted in FIG. 15 remains as a reception face that receives pressure from the pressure roller 21.

According to the third embodiment and the fourth embodiment, the notches 23*d* or 23*d*F are disposed in the horizontal faces 23*b*2. The notches 23*d* or 23*d*F decrease the contact amount with which the heater 22 contacts the heater holder 23E or 23F at the positions or in the spans in the longitudinal direction of the heater 22 or the like, where the guides 26 are disposed, respectively, thus suppressing uneven temperature of the fixing belt in the longitudinal direction thereof.

As illustrated in FIG. 11, the surface temperature T of the fixing belt 20 decreases at the positions or in the spans where the guides 26 contact the fixing belt 20, respectively. For example, the surface temperature T of the fixing belt 20 is lowest at the center of each of the guides 26 in the longitudinal direction thereof. To address this circumstance, the notch 23*d*F according to the fourth embodiment is substantially the arc as illustrated in FIG. 15, decreasing the contact amount with which the heater 22 contacts the heater holder 23F toward the center of the guide 26 in the longitudinal direction thereof. That is, the notches 23*d*F cause the contact amount to correspond to the distribution of the surface temperature T of the fixing belt 20, suppressing uneven temperature of the fixing belt 20 more effectively.

Figure 16:
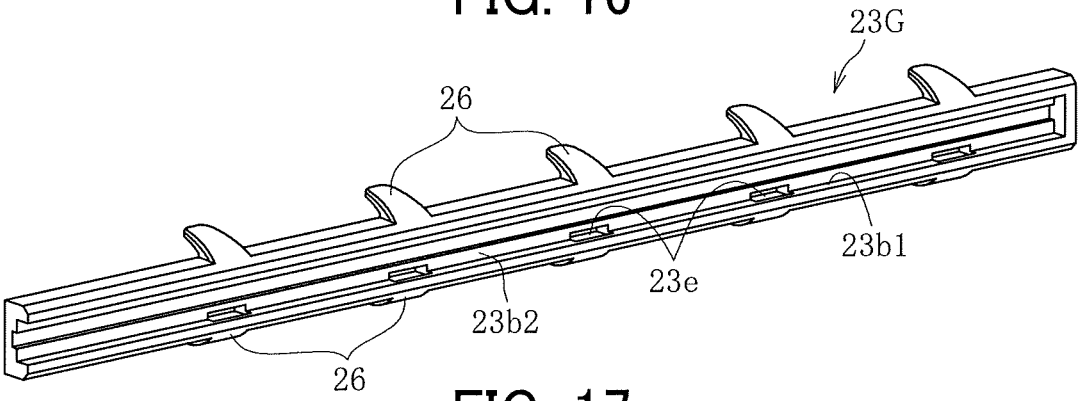
FIG. 16 is a perspective view of a heater holder according to a fifth embodiment of the present disclosure, that is installable in the fixing device depicted in FIG. 2.
Figure 17:
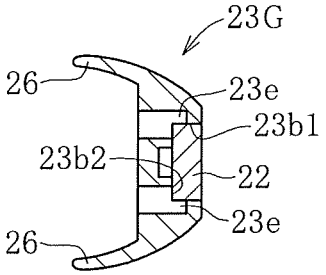
FIG. 17 is a cross-sectional view of the heater holder depicted in FIG. 16 and the heater held by the heater holder.

Referring to FIGS. 16 and 17, a description is provided of a construction of a heater holder 23G according to a fifth embodiment of the present disclosure, that is installable in the fixing device 6.

As illustrated in FIGS. 16 and 17, the heater holder 23G includes notches 23*e* disposed at positions or in spans in a longitudinal direction of the heater holder 23G, that correspond to the guides 26, respectively. For example, the notches 23*e* are disposed opposite the guides 26, respectively. The notch 23*e* bridges the vertical face 23*b*1 and the horizontal face 23*b*2. Compared to the notches 23*c*, 23*c*D, 23*d*, and 23*d*F according to the embodiments described above, that are disposed in one of the vertical face 23*b*1 and the horizontal face 23*b*2, the notch 23*e* according to this embodiment decreases the contact amount with which the heater 22 contacts the heater holder 23G at the position or in the span where the guide 26 is disposed further, thus increasing the temperature of the fixing belt 20 at the position or in the span disposed opposite the guide 26 more effectively.

Figure 18:
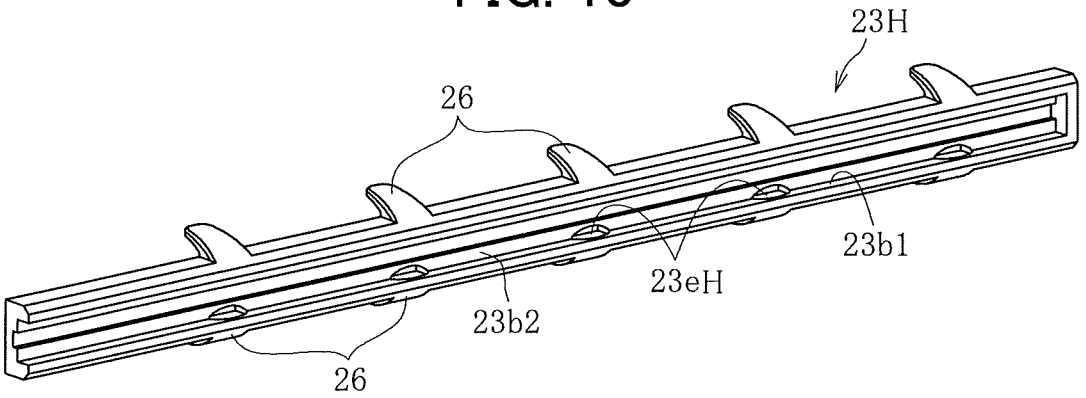
FIG. 18 is a perspective view of a heater holder according to a sixth embodiment of the present disclosure, that is installable in the fixing device depicted in FIG. 2.

Referring to FIG. 18, a description is provided of a construction of a heater holder 23H according to a sixth embodiment of the present disclosure, that is installable in the fixing device 6.

As illustrated in FIG. 18, the heater holder 23H includes notches 23*e*H each of which bridges the vertical face 23*b*1 and the horizontal face 23*b*2. A width of the notch 23*e*H increases toward a center of the notch 23*e*H in a longitudinal direction thereof. In other words, the notch 23*e*H is substantially an arc in cross section in each of the vertical face 23*b*1 and the horizontal face 23*b*2. Accordingly, the notches 23*e*H decrease the contact amount with which the heater 22 contacts the heater holder 23H in accordance with decrease in the temperature of the fixing belt 20, suppressing uneven temperature of the fixing belt 20 more effectively.

According to the embodiments described above, a heater holder (e.g., the heater holders 23, 23D, 23E, 23F, 23G, and 23H) includes notches (e.g., the notches 23*c*, 23*c*D, 23*d*, 23*d*F, 23*e*, and 23*e*H) that decrease the contact amount with which the base 30 of the heater 22 contacts the heater holder, as examples. Alternatively, the base 30 may include notches. The following describes various embodiments in which the base 30 includes the notches.

Referring to FIGS. 19, 20A, 20B, and 21, a description is provided of a construction of a heater 22J according to a seventh embodiment of the present disclosure, that is installable in the fixing device 6.

Figure 19:
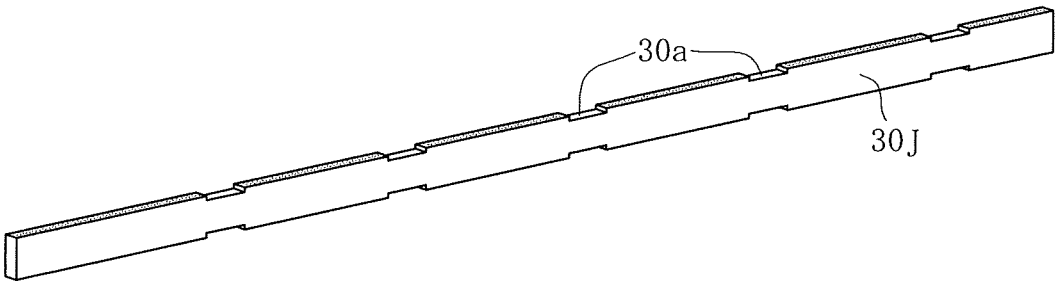
FIG. 19 is a perspective view of a base of a heater according to a seventh embodiment of the present disclosure, that is installable in the fixing device depicted in FIG. 2.
Figure 20A:
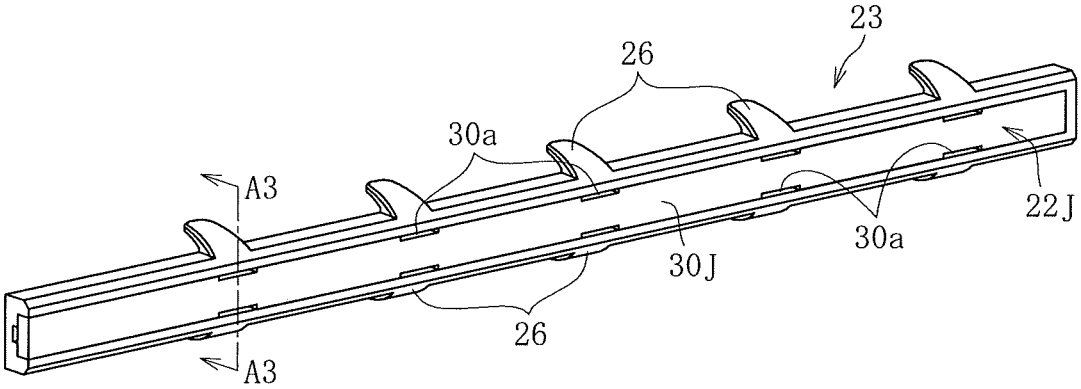
FIG. 20A is a perspective view of the heater holder depicted in FIG. 4A and the heater according to the seventh embodiment of the present disclosure, that are installable in the fixing device depicted in FIG. 2.

As illustrated in FIG. 19, the heater 22J includes a plurality of notches 30*a* disposed in both ends of a base 30J, respectively, in a short direction thereof. As illustrated in FIG. 20A, the notches 30*a* are disposed at positions or in spans in a longitudinal direction of the heater 22J, that correspond to the guides 26, respectively. For example, the notches 30*a* are disposed opposite the guides 26, respectively. The heater holder 23 incorporates no notch.

Figure 20B:
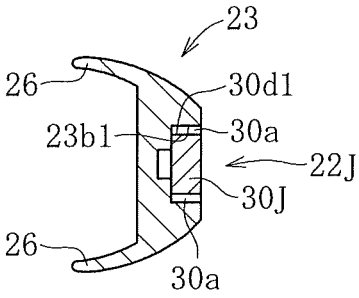
FIG. 20B is a cross-sectional view of the heater holder and the heater depicted in FIG. 20A taken on line A3-A3 in FIG. 20A.

FIG. 20A is a perspective view of the heater holder 23 and the heater 22J. FIG. 20B is a cross-sectional view of the heater holder 23 and the heater 22J taken on line A3-A3 in FIG. 20A. According to this embodiment, as illustrated in FIG. 20B, a width of the notch 30*a* in a short direction of the heater 22J (e.g., a length in a vertical direction in FIG. 20B), that is perpendicular to the longitudinal direction of the heater 22J, is substantially constant. Thus, the notch 30*a* is substantially rectangular in cross section. Accordingly, at a position or in a span of the notch 30*a*, a side face 30*d*1 of the base 30J does not contact the vertical face 23*b*1 of the heater holder 23, decreasing the contact amount with which the heater 22J contacts the heater holder 23. Additionally, a back face of the base 30J contacts the horizontal faces 23*b*2 (depicted in FIG. 4B) of the heater holder 23 with a decreased contact amount.

Figure 21:
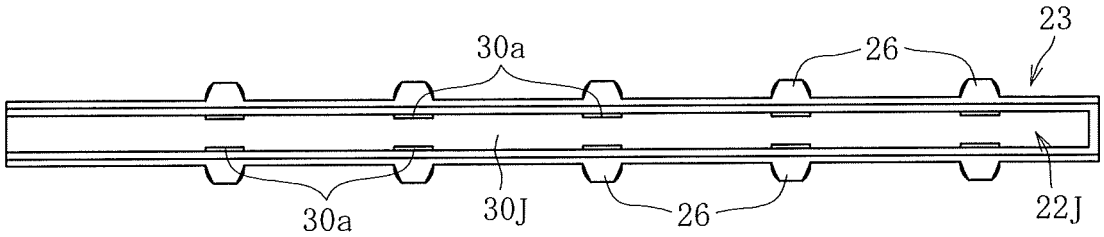
FIG. 21 is a diagram illustrating a front view of the heater holder depicted in FIG. 20A, that holds the heater, and the temperature distribution of the fixing belt in the longitudinal direction thereof, that is incorporated in the fixing device depicted in FIG. 2.
Figure 21:
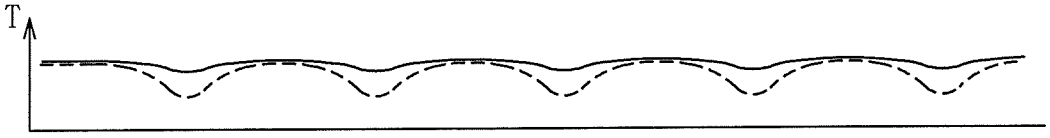

As illustrated in FIG. 21, a dotted line represents a distribution of the surface temperature T of the fixing belt 20 heated by a heater without the notches 30*a*. A solid line represents a distribution of the surface temperature T of the fixing belt 20 heated by the heater 22J according to this embodiment, that has the notches 30*a*. Compared to the dotted line, as indicated with the solid line, the notches 30*a* decrease the contact amount with which the heater 22J contacts the heater holder 23 at the positions or in the spans disposed opposite the guides 26, respectively, facilitating increase in the surface temperature T of the fixing belt 20 and suppressing uneven temperature of the fixing belt 20.

Figure 22:
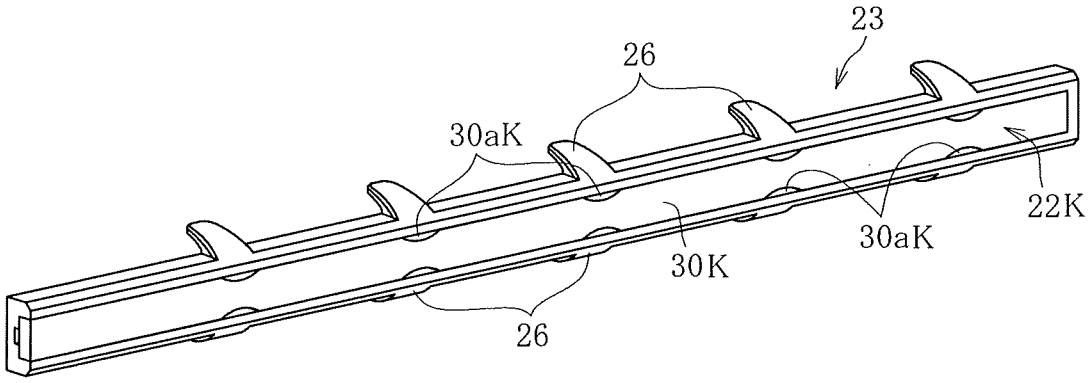
FIG. 22 is a perspective view of the heater holder depicted in FIG. 4A and a heater according to an eighth embodiment of the present disclosure, that are installable in the fixing device depicted in FIG. 2.

Referring to FIG. 22, a description is provided of a construction of a heater 22K according to an eighth embodiment of the present disclosure, that is installable in the fixing device 6.

As illustrated in FIG. 22, the heater 22K includes notches 30*a*K disposed in side faces of a base 30K, respectively. A width of the notch 30*a*K in a short direction thereof increases toward a center of the notch 30*a*K in a longitudinal direction thereof. Thus, the notch 30*a*K defines substantially an arc in cross section. Accordingly, the width of the notch 30*a*K defines a shape corresponding to the distribution of the surface temperature T of the fixing belt 20. The notch 30*a*K gradually decreases the contact amount with which a back face of the base 30K of the heater 22K contacts the horizontal faces 23*b*2 (depicted in FIG. 4B) of the heater holder 23 toward the center of the notch 30*a*K in the longitudinal direction thereof, thus suppressing uneven temperature of the fixing belt 20 more effectively. Compared to the notch 30*a* that is substantially rectangular as illustrated in FIG. 20A, the notch 30*a*K changes the width of the base 30K in the short direction thereof gently. Additionally, no corner is produced at an edge of the base 30K, improving mechanical strength of the base 30K and facilitating processing of the base 30K.

Figure 23A:
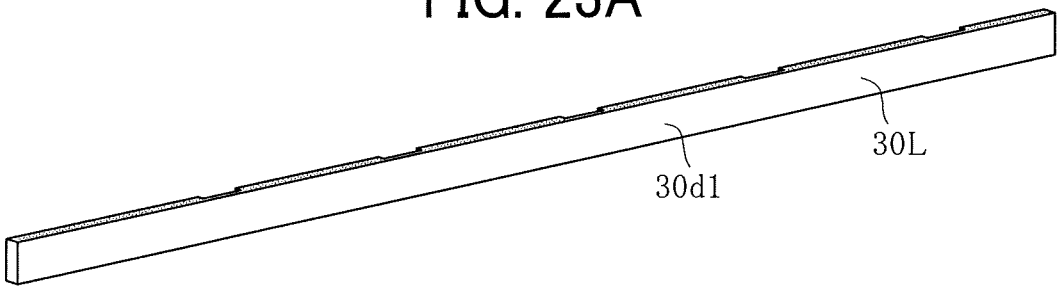
FIG. 23A is a front perspective view of a base of a heater according to a ninth embodiment of the present disclosure, that is installable in the fixing device depicted in FIG. 2.
Figure 23B:
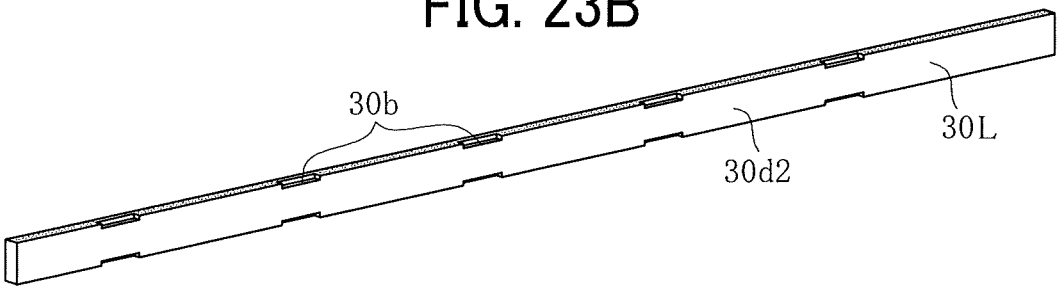
FIG. 23B is a back perspective view of the base depicted in FIG. 23A.
Figure 24:
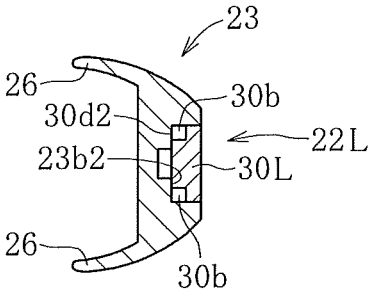
FIG. 24 is a cross-sectional view of the heater holder depicted in FIG. 4A and the heater incorporating the base depicted in FIG. 23B.

Referring to FIGS. 23A, 23B, and 24, a description is provided of a construction of a heater 22L according to a ninth embodiment of the present disclosure, that is installable in the fixing device 6.

As illustrated in FIGS. 23A and 23B, the heater 22L includes notches 30*b* disposed in a back face 30*d*2 of a base 30L. The back face 30*d*2 is opposite a front face 30*d*1 of the base 30L, that faces the fixing belt 20. The notches 30*b* are disposed at positions or in spans in a longitudinal direction of the heater 22L, that correspond to the guides 26, respectively. The notches 30*b* are disposed at both ends of the base 30L in a short direction thereof. For example, the notches 30*b* are disposed opposite the guides 26, respectively. Accordingly, as illustrated in FIG. 24, the notches 30*b* decrease the contact amount with which the back face 30*d*2 of the base 30L contacts the horizontal faces 23*b*2 of the heater holder 23 and the contact amount with which the side faces of the base 30L contact the vertical faces 23*b*1 (depicted in FIG. 4B) of the heater holder 23, respectively, thus suppressing uneven temperature of the fixing belt 20 in the longitudinal direction thereof. According to this embodiment, a part of the back face 30*d*2 of the base 30L contacts the horizontal faces 23*b*2 of the heater holder 23 also at positions in a longitudinal direction of the base 30L, where the notches 30*b* are disposed. Hence, the part of the back face 30*d*2 also serves as the reception face that receives pressure from the pressure roller 21.

Figure 25:
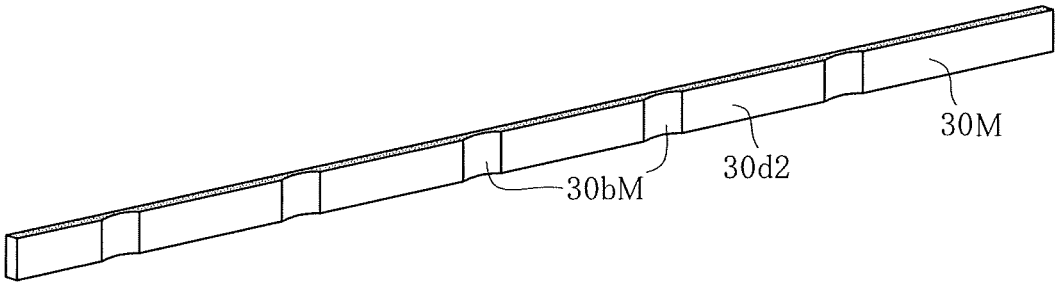
FIG. 25 is a perspective view of a base of a heater according to a tenth embodiment of the present disclosure, that is installable in the fixing device depicted in FIG. 2.

Referring to FIG. 25, a description is provided of a construction of a base 30M according to a tenth embodiment of the present disclosure, that is installable in the fixing device 6.

As illustrated in FIG. 25, the base 30M includes notches 30*b*M disposed in the back face 30*d*2 at positions or in spans in the longitudinal direction of the heater 22, that correspond to the guides 26, respectively. For example, the notches 30*b*M are disposed opposite the guides 26, respectively. The notch 30*b*M extends throughout an entirety of the base 30M in a short direction thereof. Accordingly, the notches 30*b*M separate the back face 30*d*2 from the horizontal faces 23*b*2 (depicted in FIG. 4B) at the positions or in the spans in the longitudinal direction of the heater 22, that correspond to the guides 26, respectively. Additionally, the notches 30*b*M decrease the contact amount with which side faces of the base 30M contact the vertical faces 23*b*1 (depicted in FIG. 4B) of the heater holder 23, respectively, suppressing uneven temperature of the fixing belt 20 in the longitudinal direction thereof.

The above describes the embodiments in which the heater 22 contacts the heater holder 23 directly. Alternatively, a spacer may be interposed between the heater 22 and the heater holder 23.

Figure 26:
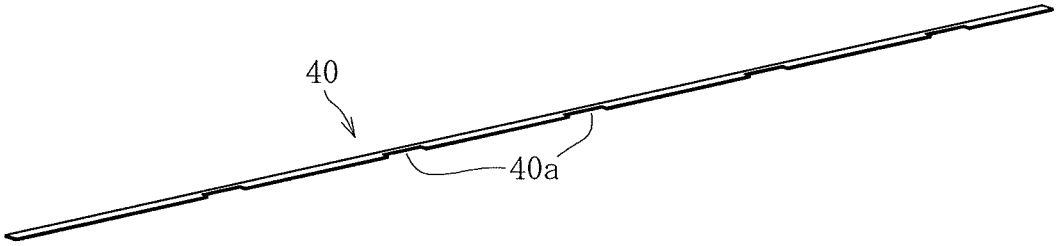
FIG. 26 is a perspective view of a spacer incorporated in a fixing device according to an eleventh embodiment of the present disclosure, that is installable in the image forming apparatus depicted in FIG. 1.
Figure 27A:
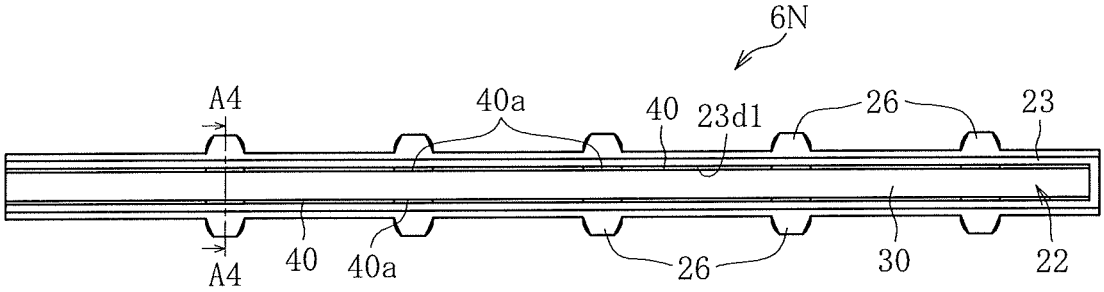
FIG. 27A is a front view of the fixing device according to the eleventh embodiment of the present disclosure, that incorporates the spacer depicted in FIG. 26.
Figure 27B:
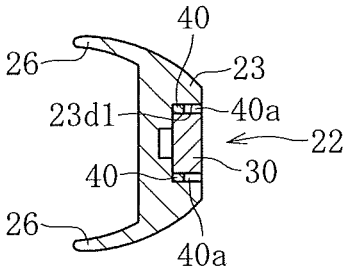
FIG. 27B is a cross-sectional view of the heater holder, the heater, and the spacer of the fixing device depicted in FIG. 27A taken on line A4-A4 in FIG. 27A.

Referring to FIGS. 26, 27A, and 27B, a description is provided of a construction of a fixing device 6N according to an eleventh embodiment of the present disclosure.

For example, as illustrated in FIGS. 26, 27A, and 27B, the fixing device 6N includes a plurality of spacers 40, each of which is thin and interposed between the heater 22 and the heater holder 23. The spacer 40 is an elongate member extending in the longitudinal direction of the heater 22 or the like. The spacer 40 includes a plurality of notches 40*a* arranged in a longitudinal direction of the spacer 40.

As illustrated in FIG. 27A, the spacers 40 are interposed between both side faces of the base 30 and vertical faces 23*d*1 of the heater holder 23, respectively. The notches 40*a* are disposed at positions or in spans in the longitudinal direction of the heater holder 23, that correspond to the guides 26, respectively. For example, the notches 40*a* are disposed opposite the guides 26, respectively.

FIG. 27A is a front view of the heater 22, the heater holder 23, and the spacer 40. FIG. 27B is a cross-sectional view of the heater 22, the heater holder 23, and the spacer 40 taken on line A4-A4 in FIG. 27A. As illustrated in FIG. 27B, the notches 40*a* disposed in the spacers 40 decrease the contact amount with which the side faces (e.g., an upper face and a lower face in FIG. 27B) of the base 30 contact the spacers 40, respectively, and the contact amount with which the spacers 40 contact the vertical faces 23*d*1 of the heater holder 23, respectively.

According to the embodiments of the present disclosure, a state in which a heater (e.g., the heater 22) contacts a holder (e.g., the heater holder 23) denotes that the heater contacts the heater holder directly or indirectly via other element such as a spacer (e.g., the spacer 40). In the fixing device 6N according to the eleventh embodiment, the notches 40*a* are disposed at the positions or in the spans in the longitudinal direction of the heater 22, where the guides 26 are disposed, that is, positions or spans where the guides 26 contact the fixing belt 20, thus decreasing the contact amount with which the side faces of the base 30 contact the spacers 40, respectively, and the contact amount with which the spacers 40 contact the vertical faces 23*d*1 of the heater holder 23, respectively. Thus, the notches 40*a* decrease an amount of heat conducted from the heater 22 to the spacers 40 and the heater holder 23, suppressing uneven temperature of the fixing belt 20.

The spacer 40 may merely be an interposed member interposed between the heater 22 and the heater holder 23 or may have a predetermined function. For example, the spacer may be an insulating member that decreases conduction of heat from the heater 22 to the heater holder 23, thus improving heating efficiency of the heater 22 that heats the fixing belt 20. Conversely, the spacer 40 may be an enhanced thermal conductivity member that facilitates conduction of heat in the longitudinal direction of the fixing belt 20, thus suppressing uneven temperature of the fixing belt 20 in the longitudinal direction thereof. The spacer 40 may be a holding member that holds a lubricant such as grease.

According to the embodiments described above, the contact amount with which the heater 22 contacts the heater holder 23 decreases at the positions or in the spans in the longitudinal direction of the heater 22, where the guides 26 are disposed. Alternatively, the embodiments of the present disclosure are applicable to other configurations or constructions. For example, in the heaters 22A, 22B, and 22C in which the resistive heat generators 35, 35B, and 35C are connected in parallel, respectively, as illustrated in FIGS. 6A, 6B, and 6C, the heat generation amount of the heaters 22A, 22B, and 22C decreases at the gaps S between adjacent ones of the resistive heat generators 35, 35B, and 35C in the longitudinal direction of the heaters 22A, 22B, and 22C. Accordingly, the surface temperature T of the fixing belt 20 also decreases.

To address this circumstance, at positions disposed opposite the gaps S or in spans disposed opposite the gaps S, like the embodiments described above, the contact amount with which the heater 22 contacts the heater holder 23 decreases to suppress uneven temperature of the fixing belt 20 according to embodiments described below. Among the heaters 22A, 22B, and 22C incorporating the resistive heat generators 35, 35B, and 35C that are connected in parallel, respectively, the adjacent ones of the resistive heat generators 35B and 35C partially overlap each other in the longitudinal direction of the heaters 22B and 22C as illustrated in FIGS. 6B and 6C. The heaters 22B and 22C decrease uneven temperature of the fixing belt compared to the heater 22A in which the adjacent ones of the resistive heat generators 35 do not overlap each other at the gap S as illustrated in FIG. 6A.

However, an objective of decreasing uneven temperature of the fixing belt 20 with constructions according to the embodiments described below is common to the constructions of the heaters 22A, 22B, and 22C depicted in FIGS. 6A, 6B, and 6C, respectively.

The following describes the constructions in which the number of the resistive heat generators 35 decreases to three and the number of the gaps S arranged in the longitudinal direction of the heater 22 is two, as examples for convenience.

Drawings according to the embodiments described below do not illustrate electrodes, feeders, an insulating layer, and the like and do illustrate the base 30 and the resistive heat generators 35 for convenience.

Figure 28A:
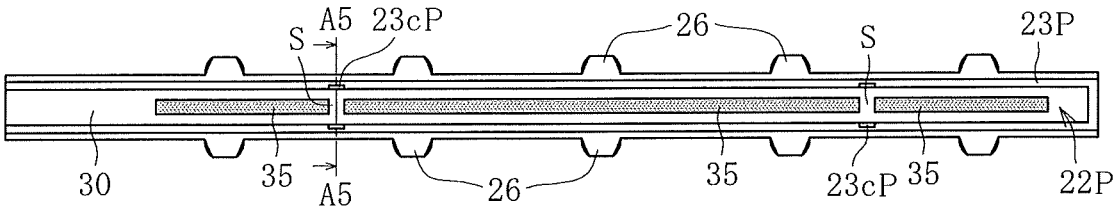
FIG. 28A is a front view of a heater holder and a heater according to a twelfth embodiment of the present disclosure, that are installable in the fixing device depicted in FIG. 2.
Figure 28B:
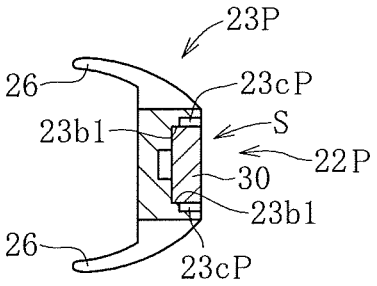
FIG. 28B is a cross-sectional view of the heater holder and the heater depicted in FIG. 28A taken on line A5-A5 in FIG. 28A.

Referring to FIGS. 28A and 28B, a description is provided of a construction of a heater 22P and a heater holder 23P according to a twelfth embodiment of the present disclosure, that are installable in the fixing device 6.

FIG. 28A is a front view of the heater 22P and the heater holder 23P. FIG. 28B is a cross-sectional view of the heater 22P and the heater holder 23P taken on line A5-A5 in FIG. 28A. As illustrated in FIGS. 28A and 28B, for example, notches 23*c*P are disposed at positions or in spans in a longitudinal direction of the heater holder 23P, that correspond to the gaps S between the adjacent ones of the resistive heat generators 35. For example, the notches 23*c*P are disposed opposite the gaps S, respectively. The notches 23*c*P decrease the contact amount with which the heater 22P contacts the heater holder 23P at the positions or in the spans in a longitudinal direction of the heater 22P, where the heater 22P generates a decreased amount of heat, thus suppressing uneven temperature of the fixing belt 20.

Alternatively, the heater 22P may include notches that decrease the contact amount with which the heater 22P contacts the heater holder 23P.

Figure 29A:
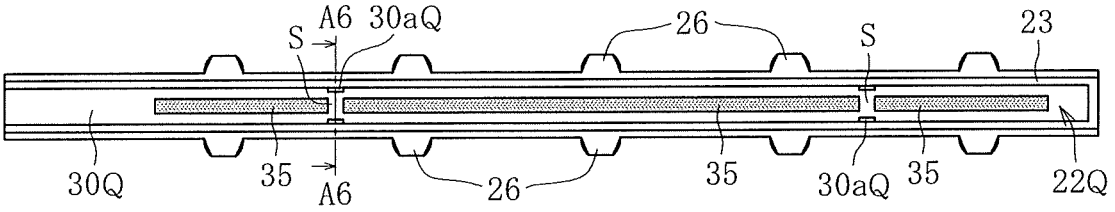
FIG. 29A is a front view of the heater holder depicted in FIG. 4A and a heater according to a thirteenth embodiment of the present disclosure, that are installable in the fixing device depicted in FIG. 2.
Figure 29B:
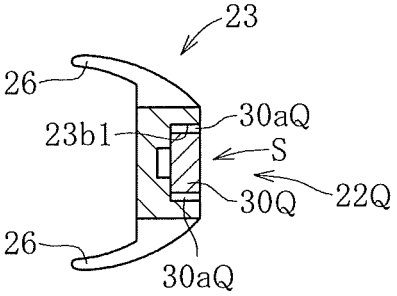
FIG. 29B is a cross-sectional view of the heater holder and the heater depicted in FIG. 29A taken on line A6-A6 in FIG. 29A.

Referring to FIGS. 29A and 29B, a description is provided of a construction of a heater 22Q according to a thirteenth embodiment of the present disclosure, that is installable in the fixing device 6.

FIG. 29A is a front view of the heater 22Q and the heater holder 23. FIG. 29B is a cross-sectional view of the heater 22Q and the heater holder 23 taken on line A6-A6 in FIG. 29A. As illustrated in FIGS. 29A and 29B, for example, notches 30*a*Q are disposed at both ends of a base 30Q in a short direction thereof, respectively. The notches 30*a*Q are disposed at positions or in spans in a longitudinal direction of the heater 22Q, that correspond to the gaps S between the adjacent ones of the resistive heat generators 35. For example, the notches 30*a*Q are disposed opposite the gaps S, respectively. The notches 30*a*Q decrease the contact amount with which the heater 22Q contacts the heater holder 23 at the positions or in the spans in the longitudinal direction of the heater 22Q, where the heater 22Q generates a decreased amount of heat, thus suppressing uneven temperature of the fixing belt 20.

Figure 30A:
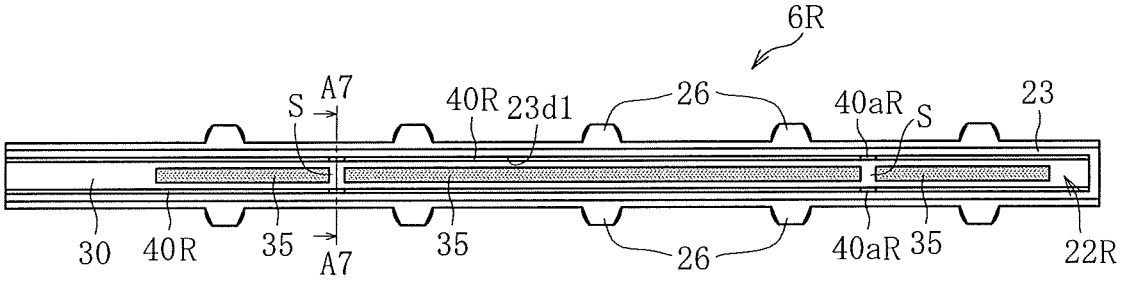
FIG. 30A is a front view of a fixing device according to a fourteenth embodiment of the present disclosure, that is installable in the image forming apparatus depicted in FIG. 1, illustrating the heater holder, a heater, and a spacer incorporated in the fixing device.
Figure 30B:
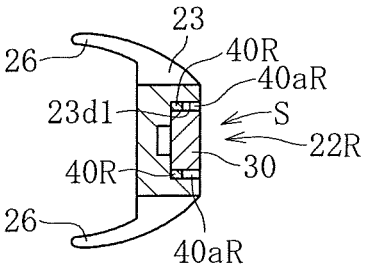
FIG. 30B is a cross-sectional view of the heater holder, the heater, and the spacer depicted in FIG. 30A taken on line A7-A7 in FIG. 30A.

Referring to FIGS. 30A and 30B, a description is provided of a construction of a fixing device 6R according to a fourteenth embodiment of the present disclosure.

FIG. 30A is a front view of a heater 22R and the heater holder 23 of the fixing device 6R. FIG. 30B is a cross-sectional view of the heater 22R and the heater holder 23 taken on line A7-A7 in FIG. 30A. As illustrated in FIGS. 30A and 30B, the fixing device 6R includes a plurality of spacers 40R, each of which is interposed between the heater 22R and the heater holder 23. The spacer 40R includes notches 40*a*R that are disposed at positions or in spans in a longitudinal direction of the heater 22R, that correspond to the gaps S, respectively. For example, the notches 40*a*R are disposed opposite the gaps S, respectively. The notches 40*a*R decrease the contact amount with which the heater 22R contacts the heater holder 23 at the positions or in the spans in the longitudinal direction of the heater 22R, where the heater 22R generates a decreased amount of heat, thus suppressing uneven temperature of the fixing belt 20.

According to the embodiments described above, each of notches (e.g., the notches 23*c*, 23*d*, 23*e*, 23*c*P, 30*a*, 30*b*, 30*b*M, 30*a*Q, 40*a*, and 40*a*R) is rectangular in cross section and has a width that does not vary in a longitudinal direction thereof. Alternatively, each of the notches may have a width that varies in the longitudinal direction thereof. For example, each of the notches may have a width that increases toward a center of each of the notches in the longitudinal direction thereof.

According to the embodiments described above, as examples, at the positions or in the spans in the longitudinal direction of the heater 22, that are disposed opposite the guides 26 in contact with the fixing belt 20, respectively, or at the positions or in the spans disposed opposite the gaps S between the adjacent ones of the resistive heat generators 35, respectively, the contact amount with which the heater 22 contacts the heater holder 23 decreases. Alternatively, both at the positions or in the spans disposed opposite the guides 26 in contact with the fixing belt 20 and at the positions or in the spans disposed opposite the gaps S, respectively, the contact amount with which the heater 22 contacts the heater holder 23 may decrease, like in the embodiments described above.

Figure 31:
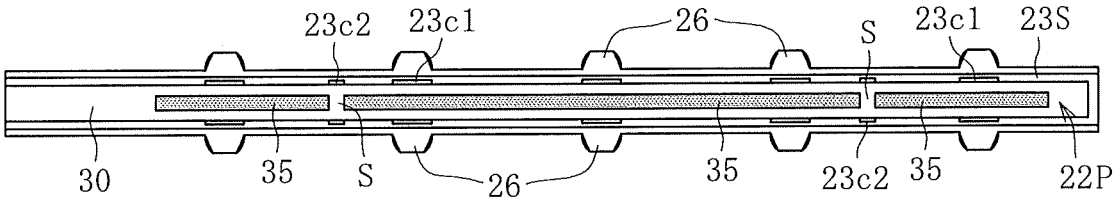
FIG. 31 is a front view of the heater depicted in FIG. 28A and a heater holder according to a fifteenth embodiment of the present disclosure, that are installable in the fixing device depicted in FIG. 2.

Referring to FIG. 31, a description is provided of a construction of a heater holder 23S according to a fifteenth embodiment of the present disclosure, that is installable in the fixing device 6.

FIG. 31 is a front view of the heater 22P and the heater holder 23S. For example, as illustrated in FIG. 31, the heater holder 23S includes notches 23*c*1 and 23*c*2. The notches 23*c*1 are disposed opposite positions or spans in a longitudinal direction of the heater holder 23S, where the guides 26 contact the fixing belt 20, respectively. For example, the notches 23*c*1 are disposed opposite the guides 26, respectively. The notches 23*c*2 are disposed opposite the gaps S between the adjacent ones of the resistive heat generators 35 of the heater 22P, respectively. The notches 23*c*1 and 23*c*2 are disposed at both ends of the heater holder 23S in a short direction thereof, respectively. The notches 23*c*1 and 23*c*2 decrease the contact amount with which the heater 22P contacts the heater holder 23S at the positions or in the spans in the longitudinal direction of the heater holder 23S that are disposed opposite the guide 26 and the gap S, respectively, thus suppressing uneven temperature of the fixing belt effectively.

Figure 32:
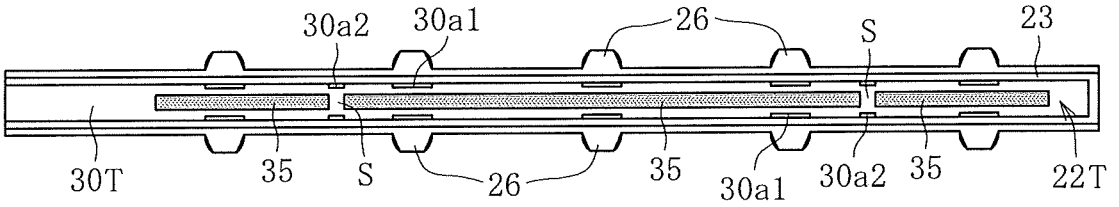
FIG. 32 is a front view of the heater holder depicted in FIG. 3A and a heater according to a sixteenth embodiment of the present disclosure, that are installable in the fixing device depicted in FIG. 2.

Referring to FIG. 32, a description is provided of a construction of a heater 22T according to a sixteenth embodiment of the present disclosure, that is installable in the fixing device 6.

As illustrated in FIG. 32, the heater 22T includes a base 30T including notches 30*a*1 and 30*a*2. The notches 30*a*1 are disposed opposite positions or spans in a longitudinal direction of the heater 22T, where the guides 26 contact the fixing belt 20, respectively. For example, the notches 30*a*1 are disposed opposite the guides 26, respectively. The notches 30*a*2 are disposed at positions or in spans in the longitudinal direction of the heater 22T, that are disposed opposite the gaps S between the adjacent ones of the resistive heat generators 35, respectively. For example, the notches 30*a*2 are disposed opposite the gaps S, respectively. The notches 30*a*1 and 30*a*2 decrease the contact amount with which the heater 22T contacts the heater holder 23 at the positions or in the spans in the longitudinal direction of the heater 22T, that are disposed opposite the guide 26 and the gap S, respectively, thus suppressing uneven temperature of the fixing belt 20 effectively.

Figure 33:
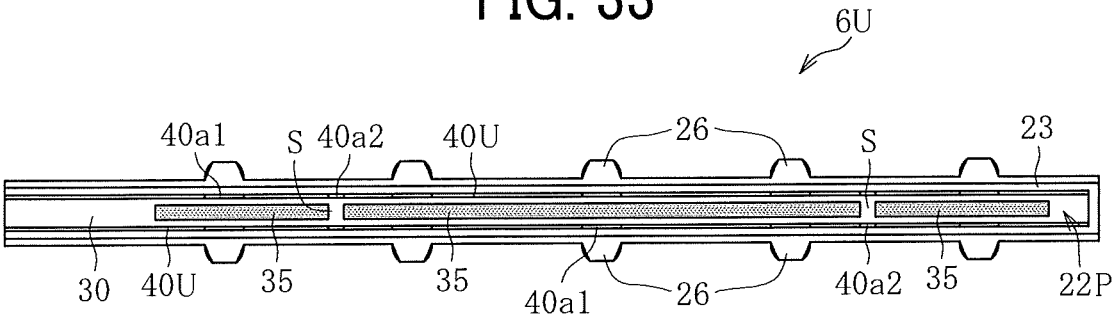
FIG. 33 is a front view of a fixing device according to a seventeenth embodiment of the present disclosure, that is installable in the image forming apparatus depicted in FIG. 2.

Referring to FIG. 33, a description is provided of a construction of a fixing device 6U according to a seventeenth embodiment of the present disclosure.

As illustrated in FIG. 33, the fixing device 6U includes a plurality of spacers 40U, each of which is interposed between the heater 22P and the heater holder 23. As illustrated in FIG. 33, the spacer 40U includes notches 40*a*1 and 40*a*2. The notches 40*a*1 are disposed opposite positions or spans in the longitudinal direction of the heater 22P, where the guides 26 contact the fixing belt 20, respectively. For example, the notches 40*a*1 are disposed opposite the guides 26, respectively. The notches 40*a*2 are disposed at positions or in spans disposed opposite the gaps S between the adjacent ones of the resistive heat generators 35 of the heater 22P, respectively. For example, the notches 40*a*2 are disposed opposite the gaps S, respectively. The notches 40*a*1 and 40*a*2 are disposed at both ends of the spacer 40U in a short direction thereof, respectively. The notches 40*a*1 and 40*a*2 decrease the contact amount with which the heater 22P contacts the heater holder 23 at the positions or in the spans in the longitudinal direction of the heater 22P, where the heater 22P generates a decreased amount of heat, thus suppressing uneven temperature of the fixing belt 20.

The above describes the embodiments of the present disclosure. However, the technology of the present disclosure is not limited to the embodiments described above and is modified within the scope of the present disclosure.

The image forming apparatus 1 according to the embodiments of the present disclosure depicted in FIG. 1 is not limited to a monochrome image forming apparatus that forms a monochrome toner image. Alternatively, the image forming apparatus 1 may be a color image forming apparatus that forms a color toner image, a copier, a printer, a facsimile machine, a multifunction peripheral (MFP) having at least two of printing, copying, facsimile, scanning, and plotter functions, or the like.

The recording media include, in addition to plain paper as a sheet P, thick paper, a postcard, an envelope, thin paper, coated paper, art paper, tracing paper, an overhead projector (OHP) transparency, plastic film, prepreg, and copper foil.

The above describes examples according to the embodiments of the present disclosure in which a heater (e.g., the heaters 22, 22A, 22B, 22C, 22J, 22K, 22L, 22P, 22Q, 22R, and 22T), a heater holder (e.g., the heater holders 23, 23D, 23E, 23F, 23G, 23H, 23P, and 23S), or a spacer (e.g., the spacers 40, 40R, and 40U) is provided with notches (e.g., the notches 23*c*, 23*c*D, 23*d*, 23*d*F, 23*e*, 23*e*H, 30*a*, 30*a*K, 30*b*, 30*b*M, 40*a*, 23*c*P, 30*a*Q, 40*a*R, 23*c*1, 23*c*2, 30*a*1, 30*a*2, 40*a*1, and 40*a*2). The notches decrease the contact amount with which the heater contacts the heater holder. However, the embodiments of the present disclosure are not limited to the examples described above. The heater, the heater holder, or the spacer may have a proper shape that decreases the contact area where the heater contacts the heater holder. Specifically, the heater, the heater holder, or the spacer may partially incorporate a recess such as a depression that separates the heater from the heater holder. For example, a contact face of the heater, the heater holder, or the spacer may have increased surface roughness that decreases the contact amount with which the heater contacts the heater holder.

The above describes examples according to the embodiments of the present disclosure in which the guides 26 are a part of the heater holder. For example, the guides 26 are combined with the heater holder. Alternatively, the guides 26 may be provided separately from the heater holder.

Figure 34:
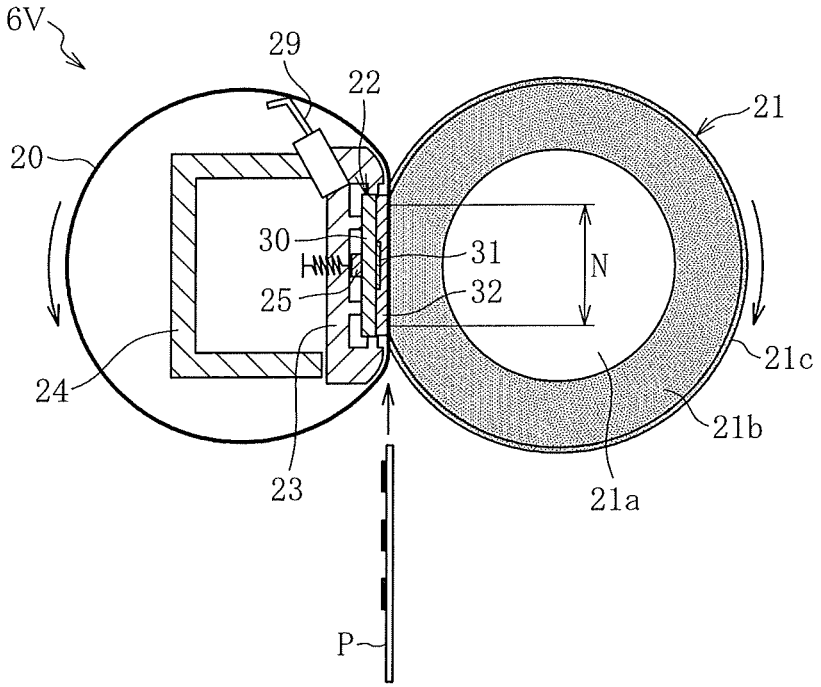
FIG. 34 is a schematic cross-sectional view of a fixing device installable in the image forming apparatus depicted in FIG. 1, illustrating a thermistor incorporated in the fixing device.

The above describes examples according to the embodiments of the present disclosure in which the guides 26 serve as contact members that contact the fixing belt 20 partially in the longitudinal direction thereof. Alternatively, the embodiments of the present disclosure are applicable to other configurations or constructions. FIG. 34 illustrates a fixing device 6V incorporating a thermistor 29 serving as a temperature detector that contacts the inner circumferential surface of the fixing belt 20 and detects the temperature of the inner circumferential surface of the fixing belt 20. For example, a temperature detector such as the thermistor 29 depicted in FIG. 34 may serve as a contact member that contacts a surface of the fixing belt 20 and detects the temperature of the fixing belt 20. As illustrated in FIG. 2, a separator 28 such as a separation claw that separates a sheet P from the fixing belt 20 may serve as a contact member. The separator 28 is disposed downstream from the fixing nip N in the sheet conveyance direction.

According to the embodiments described above, for example, as illustrated in FIG. 9A, the notches 23*c* are disposed at both ends of the heater holder 23 in the short direction thereof, respectively. As illustrated in FIG. 19, the notches 30*a* are disposed at both ends of the base 30J in the short direction thereof, respectively. As illustrated in FIG. 27A, the spacer 40 is interposed between the side face of the base 30 and the vertical face 23*d*1 of the heater holder 23 at each end of the heater 22 in the short direction thereof. The spacer 40 includes the notches 40*a*. Alternatively, the notches 23*c*, 30*a*, and 40*a* may be disposed at one end of the heater holder 23, the base 30J, and the spacer 40 in the short direction thereof, respectively.

If the notches 23*c*, 30*a*, and 40*a* are disposed at one end of the heater holder 23, the base 30J, and the spacer 40 in the short direction thereof, respectively, the notches 23*c*, 30*a*, and 40*a* are preferably disposed downstream from a center NC (depicted in FIG. 2) of the fixing nip N in the rotation direction of the fixing belt 20 or the sheet conveyance direction. That is, the notches 23*c*, 30*a*, and 40*a* are preferably disposed above the center NC of the fixing nip N in FIG. 2. For example, looseness may generate between the base 30J (depicted in FIG. 20A) and the heater holder 23 that holds the base 30J depending on settings such as dimension of each of the base 30J and the heater holder 23. When the fixing device 6 is energized and performs fixing, the fixing belt 20 rotates as illustrated in FIG. 2 and the base 30J receives a force directed downstream in the rotation direction of the fixing belt 20. Hence, the looseness may generate in an upstream part of the base 30J and the heater holder 23 in the rotation direction of the fixing belt 20. To address this circumstance, according to the embodiments of the present disclosure, the notches 23*c*, 30*a*, and 40*a* are disposed in a downstream part of the heater holder 23, the base 30J, and the spacer 40, respectively, in the rotation direction of the fixing belt 20 because the base 30J is subject to contact with the heater holder 23 in the downstream part. Thus, the notches 23*c*, 30*a*, and 40*a* suppress uneven temperature of the fixing belt 20 more precisely.

The above describes examples according to the embodiments of the present disclosure in which a heater (e.g., the heater 22, 22A, 22B, 22C, 22J, 22K, 22L, 22P, 22Q, 22R, and 22T) includes a base (e.g., the bases 30, 30J, 30K, 30L, 30M, 30Q, and 30T) as a part of the heater, that contacts a heater holder (e.g., the heater holders 23, 23D, 23E, 23F, 23G, 23H, 23P, and 23S). The base includes notches (e.g., the notches 30*a*, 30*a*K, 30*b*, 30*b*M, 30*a*Q, 30*a*1, and 30*a*2) that decrease the contact amount with which the heater contacts the heater holder. Alternatively, other portion of the heater may contact the heater holder with a decreased contact amount. For example, the heater may be provided with a thermal equalizer that equalizes an amount of heat generated by the heater by conducting heat in a longitudinal direction of the heater.

Figure 35:
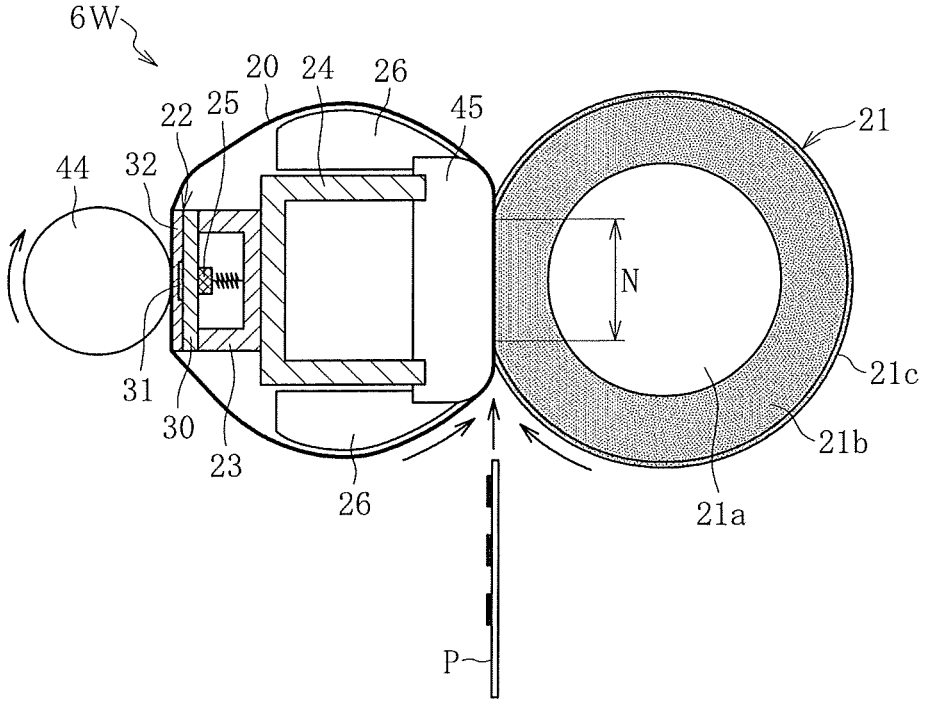
FIG. 35 is a schematic cross-sectional view of a fixing device installable in the image forming apparatus depicted in FIG. 1 as a first variation of the fixing device depicted in FIG. 2.
Figure 36:
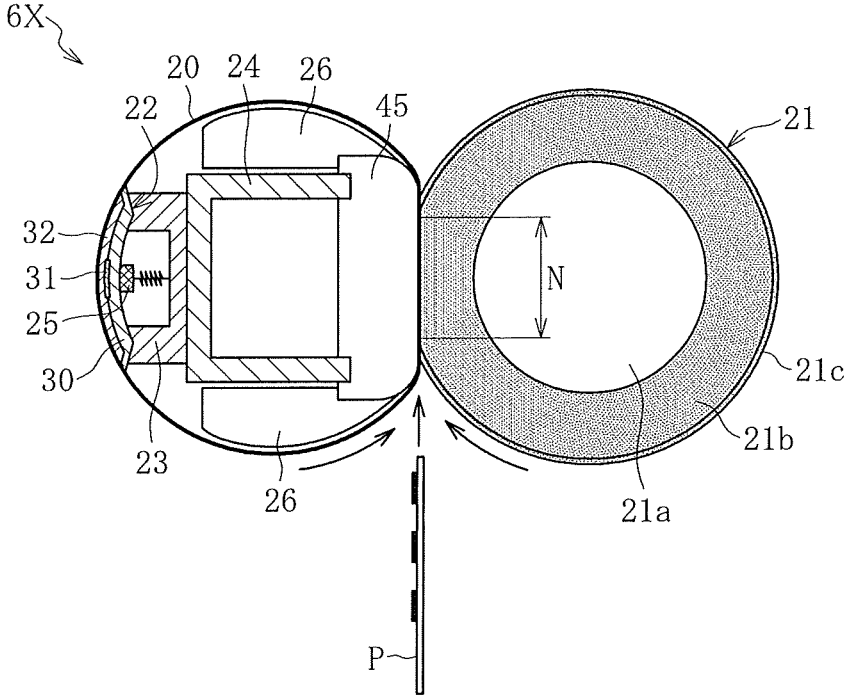
FIG. 36 is a schematic cross-sectional view of a fixing device installable in the image forming apparatus depicted in FIG. 1 as a second variation of the fixing device depicted in FIG. 2.
Figure 37:
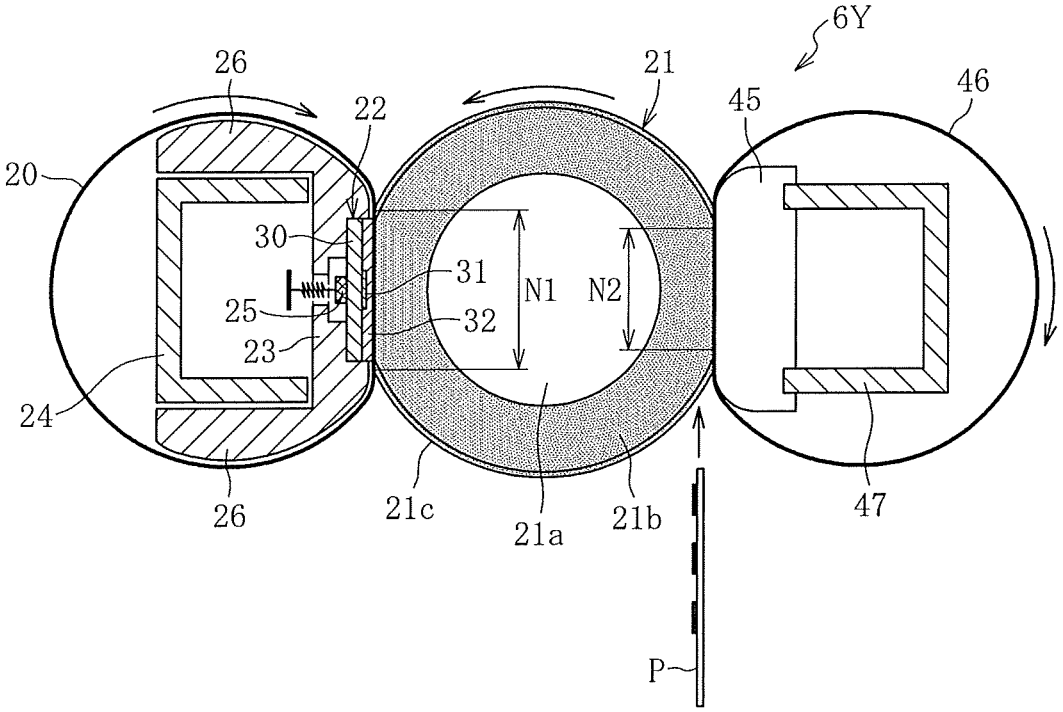
FIG. 37 is a schematic cross-sectional view of a fixing device installable in the image forming apparatus depicted in FIG. 1 as a third variation of the fixing device depicted in FIG. 2.

The embodiments of the present disclosure are applicable to fixing devices 6W, 6X, and 6Y illustrated in FIGS. 35 to 37, respectively, other than the fixing device 6 illustrated in FIG. 2, for example. The following briefly describes a construction of each of the fixing devices 6W, 6X, and 6Y depicted in FIGS. 35 to 37, respectively.

A description is provided of the construction of the fixing device 6W.

As illustrated in FIG. 35, the fixing device 6W includes a pressing roller 44 disposed opposite the pressure roller 21 via the fixing belt 20. The pressing roller 44 and the heater 22 sandwich the fixing belt 20 so that the heater 22 heats the fixing belt 20. On the other hand, a nip forming pad 45 is disposed inside the loop formed by the fixing belt 20 and disposed opposite the pressure roller 21. The stay 24 supports the nip forming pad 45. The nip forming pad 45 and the pressure roller 21 sandwich the fixing belt 20 and define the fixing nip N. The nip forming pad 45 mounts the guides 26 that guide the fixing belt 20.

A description is provided of the construction of the fixing device 6X depicted in FIG. 36.

As illustrated in FIG. 36, the fixing device 6X does not include the pressing roller 44 described above with reference to FIG. 35. In order to attain a contact length for which the heater 22 contacts the fixing belt 20 in the circumferential direction thereof, the heater 22 is curved into an arc in cross section that corresponds to a curvature of the fixing belt 20. Other construction of the fixing device 6X is equivalent to that of the fixing device 6W depicted in FIG. 35.

A description is provided of the construction of the fixing device 6Y depicted in FIG. 37.

As illustrated in FIG. 37, the fixing device 6Y includes a pressure belt 46 in addition to the fixing belt 20. The pressure belt 46 and the pressure roller 21 form a fixing nip N2 serving as a secondary nip separately from a heating nip Ni serving as a primary nip formed between the fixing belt 20 and the pressure roller 21. For example, the nip forming pad 45 and a stay 47 are disposed opposite the fixing belt 20 via the pressure roller 21. The pressure belt 46 that is rotatable accommodates the nip forming pad 45 and the stay 47. As a sheet P bearing a toner image is conveyed through the fixing nip N2 formed between the pressure belt 46 and the pressure roller 21, the pressure belt 46 and the pressure roller 21 fix the toner image on the sheet P under heat and pressure. Other construction of the fixing device 6Y is equivalent to that of the fixing device 6 depicted in FIG. 2.

Also in the fixing devices 6W, 6X, and 6Y having the constructions described above, respectively, the contact amount with which the heater 22 contacts the heater holder 23 decreases at the positions or in the spans in the longitudinal direction of the heater 22, that are disposed opposite the guides 26 and the gaps S between the resistive heat generators 35, respectively. Accordingly, uneven temperature of the fixing belt 20 is suppressed, preventing variation in gloss of a toner image formed on a sheet P and fixing failure in fixing the toner image on the sheet P.

A description is provided of advantages of a fixing device (e.g., the fixing devices 6, 6N, 6R, 6U, 6W, 6X, and 6Y).

As illustrated in FIGS. 2 and 10A, the fixing device includes a fixing belt (e.g., the fixing belt 20), a pressure rotator (e.g., the pressure roller 21), a heater (e.g., the heaters 22, 22A, 22B, 22C, 22J, 22K, 22L, 22P, 22Q, 22R, and 22T), a contact member (e.g., the guide 26, the separator 28, and the thermistor 29), and a holder (e.g., the heater holders 23, 23D, 23E, 23F, 23G, 23H, 23P, and 23S). The fixing belt is rotatable and endless. The pressure rotator presses against the fixing belt. The heater is disposed opposite or in contact with an inner circumferential surface of the fixing belt. The heater heats the fixing belt. The contact member contacts the fixing belt partially in a longitudinal direction of the fixing belt. The holder holds the heater.

The heater contacts the holder with a first contact amount in a first span in a longitudinal direction of the heater, where the contact member contacts the fixing belt. The heater contacts the holder with a second contact amount in a second span in the longitudinal direction of the heater, where the contact member does not contact the fixing belt. The second contact amount is greater than the first contact amount.

According to the embodiments of the present disclosure, a contact amount with which the heater contacts the holder decreases at a part of the heater or the holder, decreasing an amount of heat drawn by the holder from the heater and thereby suppressing variation in temperature of the fixing belt in the longitudinal direction thereof.

According to the embodiments described above, the fixing belt 20 serves as a fixing belt. Alternatively, a fixing film, a fixing sleeve, or the like may be used as a fixing belt. Further, the pressure roller 21 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:

a fixing belt that is endless, the fixing belt configured to rotate in a rotation direction;

a pressure rotator configured to press against the fixing belt to form a nip between the fixing belt and the pressure rotator;

a heater disposed opposite an inner circumferential surface of the fixing belt, the heater configured to heat the fixing belt;

a contact member configured to contact the fixing belt partially in a longitudinal direction of the fixing belt; and a holder configured to hold the heater, the heater configured to contact the holder with a first contact amount in a first span in a longitudinal direction of the heater, the first span where the contact member contacts the fixing belt, the heater configured to contact the holder with a second contact amount, that is greater than the first contact amount, in a second span in the longitudinal direction of the heater, the second span where the contact member does not contact the fixing belt.

2. The fixing device according to claim 1, wherein the heater includes:

a first heat generator; and a second heat generator arranged with the first heat generator in the longitudinal direction of the heater with a gap between the first heat generator and the second heat generator, wherein the heater is configured to contact the holder with a third contact amount in a third span in the longitudinal direction of the heater, the third span disposed opposite the gap, and wherein the heater is configured to contact the holder with a fourth contact amount, that is greater than the third contact amount, in a fourth span in the longitudinal direction of the heater, the fourth span disposed opposite each of the first heat generator and the second heat generator.

3. The fixing device according to claim 1, wherein the holder includes a notch disposed opposite the contact member.

4. The fixing device according to claim 3, wherein the notch is rectangular in cross section.

5. The fixing device according to claim 3, wherein the notch includes an arc in cross section.

6. The fixing device according to claim 1, wherein the heater includes a notch disposed opposite the contact member.

7. The fixing device according to claim 6, wherein the holder sandwiches the heater in the rotation direction of the fixing belt, and wherein the notch is disposed downstream from a center of the nip in the rotation direction of the fixing belt.

8. The fixing device according to claim 1, further comprising a spacer interposed between the holder and the heater.

9. The fixing device according to claim 8, wherein the spacer includes a notch disposed opposite the contact member.

10. The fixing device according to claim 9, further comprising another spacer interposed between the holder and the heater and disposed upstream from a center of the nip in the rotation direction of the fixing belt, wherein the holder sandwiches the heater in the rotation direction of the fixing belt, and wherein the spacer is disposed downstream from the center of the nip in the rotation direction of the fixing belt.

11. The fixing device according to claim 1, wherein the contact member includes a guide configured to contact the inner circumferential surface of the fixing belt, the guide configured to guide the fixing belt while the fixing belt rotates.

12. The fixing device according to claim 1, wherein the contact member includes a temperature detector configured to detect a temperature of a surface of the fixing belt.

13. The fixing device according to claim 1, wherein the contact member includes a separator configured to separate a recording medium conveyed through the nip from the fixing belt.

14. A fixing device comprising:

a fixing belt that is endless, the fixing belt configured to rotate in a rotation direction;

a pressure rotator configured to press against the fixing belt;

a heater disposed opposite an inner circumferential surface of the fixing belt, the heater configured to heat the fixing belt; and a holder configured to hold the heater, the heater including:

a first heat generator; and a second heat generator arranged with the first heat generator in a longitudinal direction of the heater with a gap between the first heat generator and the second heat generator, the heater configured to contact the holder with a first contact amount in a first span in the longitudinal direction of the heater, the first span disposed opposite the gap, the heater configured to contact the holder with a second contact amount, that is greater than the first contact amount, in a second span in the longitudinal direction of the heater, the second span disposed opposite each of the first heat generator and the second heat generator.

15. An image forming apparatus comprising:

an image bearer configured to bear an image; and a fixing device configured to fix the image on a recording medium, the fixing device including:

a fixing belt that is endless, the fixing belt configured to rotate in a rotation direction;

a pressure rotator configured to press against the fixing belt to form a nip between the fixing belt and the pressure rotator;

a heater disposed opposite an inner circumferential surface of the fixing belt, the heater configured to heat the fixing belt;

a contact member configured to contact the fixing belt partially in a longitudinal direction of the fixing belt; and a holder configured to hold the heater, the heater configured to contact the holder with a first contact amount in a first span in a longitudinal direction of the heater, the first span where the contact member contacts the fixing belt, the heater configured to contact the holder with a second contact amount, that is greater than the first contact amount, in a second span in the longitudinal direction of the heater, the second span where the contact member does not contact the fixing belt.

* * * * *